US010632393B2

(12) United States Patent
Jun et al.

(10) Patent No.: US 10,632,393 B2
(45) Date of Patent: Apr. 28, 2020

(54) MECHANIZED TAIL FOR MOBILE DEVICES

(71) Applicant: Petronics Inc., Champaign, IL (US)

(72) Inventors: David Jun, Urbana, IL (US); Michael Friedman, Champaign, IL (US); David Cohen, Champaign, IL (US); Dario Aranguiz, Urbana, IL (US); Russell Jones, Champaign, IL (US)

(73) Assignee: Petronics Inc., Champaign, IL (US)

( * ) Notice: Subject to any disclaimer, the term of this patent is extended or adjusted under 35 U.S.C. 154(b) by 0 days.

(21) Appl. No.: 15/868,846

(22) Filed: Jan. 11, 2018

(65) Prior Publication Data

US 2018/0200637 A1 Jul. 19, 2018

Related U.S. Application Data

(60) Provisional application No. 62/446,331, filed on Jan. 13, 2017.

(51) Int. Cl.

| | |
|---|---|
| ***A63H 17/00*** | (2006.01) |
| ***A63H 29/24*** | (2006.01) |
| ***A63H 31/08*** | (2006.01) |
| ***A63H 17/40*** | (2006.01) |
| ***A63H 17/26*** | (2006.01) |
| ***A63H 30/04*** | (2006.01) |

(52) U.S. Cl.

CPC ..... *A63H 17/004* (2013.01); *A63H 17/262* (2013.01); *A63H 17/40* (2013.01); *A63H 29/24* (2013.01); *A63H 30/04* (2013.01); *A63H 31/08* (2013.01)

(58) Field of Classification Search

CPC .... A63H 17/004; A63H 30/04; A63H 17/262; A63H 31/08; A63H 29/24; A63H 17/40

See application file for complete search history.

(56) References Cited

U.S. PATENT DOCUMENTS

| | | | | |
|---|---|---|---|---|
| 5,727,986 | A * | 3/1998 | Stubenfoll | A63H 30/04 446/437 |
| 2001/0004578 | A1 | 6/2001 | Jaffe | |
| 2003/0224695 | A1 * | 12/2003 | Kislevitz | A63H 17/262 446/437 |
| 2004/0111184 | A1 | 6/2004 | Chiappetta et al. | |
| 2008/0261487 | A1 * | 10/2008 | Torres | A63H 17/004 446/448 |

(Continued)

OTHER PUBLICATIONS http://www.wa4dsy.com/robot/t-boner-2-0 ; Sep. 3, 2016 (Year: 2016).*

(Continued)

*Primary Examiner* — Jeffrey S Vanderveen

(57) ABSTRACT

A mobile device (e.g., wireless wheeled vehicle) that includes one or more propulsion mechanisms (e.g., one or more drive wheels) and a member (e.g., a mechanized tail). The propulsion mechanism(s) are operable to propel the mobile device across a driving surface. The member is positionable to maintain or change an orientation of the mobile device with respect to the driving surface. The member has a base portion opposite a free end portion. The base portion is pivotably mounted to a portion of the mobile device. The base portion is pivotable to move the free end portion toward and away from the driving surface.

19 Claims, 15 Drawing Sheets

(56) References Cited

U.S. PATENT DOCUMENTS

2012/0322341 A1 10/2012 Benedict et al.
2013/0065482 A1* 3/2013 Trickett ..... A63H 11/00
446/397

OTHER PUBLICATIONS

International Search Report and Written Opinion, dated Apr. 4, 2018, received in Application No. PCT/US18/13607.

* cited by examiner

118

MECHANIZED TAIL FOR MOBILE DEVICES

CROSS REFERENCE TO RELATED APPLICATION(S)

This application claims the benefit of U.S. Provisional Application No. 62/446,331, filed on Jan. 13, 2017, which is incorporated herein by reference in its entirety.

BACKGROUND OF THE INVENTION

Field of the Invention

The present invention is directed generally to mobile or wireless vehicles and more particularly to devices and methods of controlling such vehicles.

Description of the Related Art

Mobile or wireless vehicles are used for practical applications as well as for entertainment. Unfortunately, many such vehicles may become positioned in undesired orientations (e.g., upside down) during use. Thus, a need exists for methods of controlling such vehicles that help maintain the vehicles in desired orientations (e.g., right-side up). Methods of reorienting mobile or wireless vehicles during use are particularly desirable. The present application provides these and other advantages as will be apparent from the following detailed description and accompanying figures.

SUMMARY

An exemplary embodiment is a wireless wheeled vehicle that includes a first portion opposite a second portion, one or more drive wheels operable to propel the wireless wheeled vehicle across a driving surface, and a member having a base portion opposite a free end portion. The base portion is pivotably mounted to the second portion of the wireless wheeled vehicle. The base portion is pivotable to move the free end portion toward and away from the driving surface. The member is positionable to maintain or change an orientation of the wireless wheeled vehicle with respect to the driving surface. Optionally, the member is positionable to flip the wireless wheeled vehicle from an undesired orientation to a desired orientation.

Optionally, the base portion is pivotable in a direction that moves the free end portion toward the driving surface, the base portion is pivoted in the direction when the wireless wheeled vehicle is in the undesired orientation to position the free end portion in contact with the driving surface and cause the member to lift the one or more drive wheels off the driving surface. The first portion of the wireless wheeled vehicle is in contact with the driving surface when the one or more drive wheels are lifted off the driving surface. Optionally, the wireless wheeled vehicle flips about the first portion into the desired orientation when the free end portion continues moving in the direction at least until the wireless wheeled vehicle rotates about the first portion and flips about the first portion into the desired orientation.

Optionally, the base portion is pivotable in a first direction and a different second direction. The first direction moves the free end portion toward the driving surface. The base portion is pivoted in the first direction when the wireless wheeled vehicle is in the undesired orientation to position the free end portion in contact with the driving surface and cause the member to lift the one or more drive wheels off the driving surface. The member is operable to cause the wireless wheeled vehicle to fall onto the member by continuing to move the free end portion in the first direction after the one or more drive wheels have been lifted off the driving surface. The wireless wheeled vehicle flips about the second portion into the desired orientation when the free end portion moves in the second direction, after the wireless wheeled vehicle has fallen, at least until the wireless wheeled vehicle rotates about the second portion and flips into the desired orientation.

Optionally, the wireless wheeled vehicle includes an onboard control mechanism configured to determine whether the wireless wheeled vehicle is in the undesired orientation or the desired orientation. The onboard control mechanism is configured to cause the member to flip the wireless wheeled vehicle into the desired orientation when the onboard control mechanism determines the wireless wheeled vehicle is in the undesired orientation. Optionally, the wireless wheeled vehicle includes at least one navigation sensor configured to send navigation information to the onboard control mechanism. Optionally, the onboard control mechanism is configured to cause the one or more drive wheels to move the wireless wheeled vehicle across the driving surface autonomously based on the navigation information only when the wireless wheeled vehicle is in the desired orientation. Optionally, the wireless wheeled vehicle includes an inertial measurement device configured to send orientation information to the onboard control mechanism. Optionally, the onboard control mechanism is configured to determine whether the wireless wheeled vehicle is in the undesired orientation or the desired orientation based at least in part on the orientation information.

Optionally, the member is positionable to help prevent the wireless wheeled vehicle from losing balance when the driving surface includes uneven or slippery terrain.

Optionally, the wireless wheeled vehicle includes an onboard control mechanism configured to receive instructions from at least one external system and cause the base portion to pivot in accordance with those instructions.

Optionally, the wireless wheeled vehicle includes at least one actuator operable to pivot the base portion, and an onboard control mechanism configured to send pivot instructions to the at least one actuator. Optionally, the at least one actuator is operable to pivot the base portion in accordance with the pivot instructions.

Optionally, the wireless wheeled vehicle includes a gear box operable to pivot the base portion, at least one actuator connected to the gear box, and an onboard control mechanism configured to send pivot instructions to the at least one actuator. Optionally, the at least one actuator is operable to cause the gear box to pivot the base portion in accordance with the pivot instructions.

Optionally, the wireless wheeled vehicle includes an onboard control mechanism, and a motion drive configured to receive drive instructions from the onboard control mechanism and operate the one or more drive wheels in accordance with the drive instructions.

Optionally, the wireless wheeled vehicle includes an attachment configured to be attached to the member and to be movable thereby.

Optionally, the first portion is a front portion and the second portion is a back portion. The wireless wheeled vehicle has a side portion that is different from the front and back portions. The wireless wheeled vehicle is a desired orientation when the one or more drive wheels are on the driving surface and the wireless wheeled vehicle is an undesired orientation when the side portion is on the driving surface. Optionally, the member is positionable such that when the wireless wheeled vehicle is the undesired orientation, operating at least one of the one or more drive wheels causes the wireless wheeled vehicle to roll into the desired orientation.

Another exemplary embodiment is a wireless vehicle that includes one or more propulsion mechanisms, a back portion, and a mechanized tail. The one or more propulsion mechanisms are positioned on a driving surface and are configured to move the wireless vehicle across the driving surface. The back portion is positioned above the drive surface by the one or more propulsion mechanisms. The mechanized tail has a base portion opposite a free end portion. The base portion is pivotably mounted to the back portion and is pivotable in first and second directions. The first direction moves the free end portion toward the driving surface and is different from the second direction. The mechanized tail is configured to flip the wireless vehicle from a first orientation to a second orientation when (a) the base portion is pivoted in the first direction thereby causing the free end portion to contact the driving surface, the mechanized tail to lift the one or more propulsion mechanisms off the driving surface, and the wireless vehicle to fall backwardly onto the mechanized tail, and (b) the base portion is pivoted in the second direction, after the wireless vehicle has fallen, at least until the wireless vehicle rotates about the back portion and into the second orientation.

Optionally, the wireless vehicle includes an onboard control mechanism configured to receive instructions from at least one external system and cause the base portion to pivot in accordance with those instructions.

Optionally, the wireless vehicle includes an onboard control mechanism configured to determine whether the wireless vehicle is in the first orientation or the second orientation, and cause the mechanized tail to flip the wireless vehicle into the second orientation when the onboard control mechanism determines the wireless vehicle is in the first orientation. Optionally, the wireless vehicle includes at least one navigation sensor configured to send navigation information to the onboard control mechanism, the onboard control mechanism being configured to cause the wireless vehicle to move across the driving surface autonomously based on the navigation information only when the wireless vehicle is in the second orientation. Optionally, the wireless vehicle includes an inertial measurement device configured to send orientation information to the onboard control mechanism, the onboard control mechanism being configured to determine whether the wireless vehicle is in the first orientation or the second orientation based at least in part on the orientation information.

Optionally, the wireless vehicle includes an onboard control mechanism configured to send pivot instructions, and at least one actuator configured to receive the pivot instructions. Optionally, the at least one actuator is operable to pivot the base portion in at least one of the first and second directions in accordance with the pivot instructions.

Optionally, the wireless vehicle includes an onboard control mechanism configured to send pivot instructions, at least one actuator configured to receive the pivot instructions, and a gear box connected to both the at least one actuator and the base portion, the at least one actuator being operable to cause the gear box to pivot the base portion in at least one of the first and second directions in accordance with the pivot instructions.

Another exemplary embodiment is a method performed by a mobile device when the mobile device is in an undesired orientation. The mobile device includes a movable member with a base portion opposite a free end portion. The base portion is pivotably mounted to a pivot portion of the mobile device. The method includes (a) pivoting the movable member in a first direction to move the free end portion into contact with a driving surface and lift a lifted portion of the mobile device, (b) continuing to pivot the movable member in the first direction, at least until the lifted portion of the mobile device falls onto the movable member, and (c) pivoting the movable member in a second direction, after the lifted portion of the mobile device has fallen, at least until the mobile device rotates about the pivot portion and into a desired orientation. The second direction is different from the first direction.

BRIEF DESCRIPTION OF THE SEVERAL VIEWS OF THE DRAWINGS

The accompanying figures are included to provide a further understanding, and are incorporated in and constitute a part of this specification. The drawings illustrate one or more embodiments. As such, the disclosure will become more fully understood from the following detailed description, taken in conjunction with the accompanying figures.

Like reference numerals have been used in the figures to identify like components.

DETAILED DESCRIPTION OF EMBODIMENTS

Figure 13:
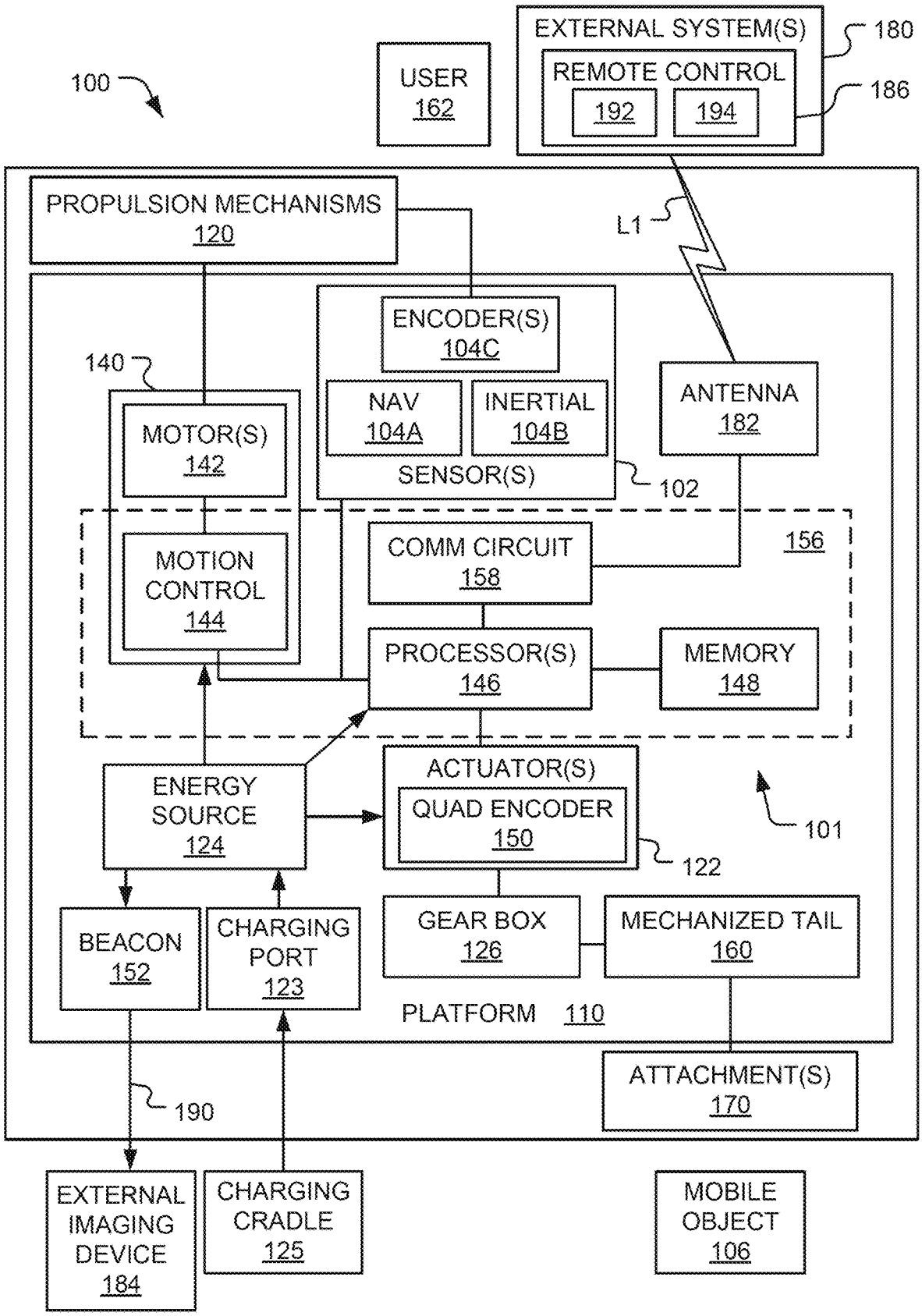
FIG. 13 is a block diagram illustrating exemplary components of the mobile device.

FIG. 13 is a block diagram of an exemplary mobile device 100. The mobile device 100 may be characterized as being a robot or robotic vehicle and may be implemented as a wireless wheeled vehicle. The mobile device 100 may operate as a full or partially autonomous vehicle. The mobile device 100 may be configured to receive instructions from one or more external systems 180 (e.g., operated by a user 162).

The mobile device 100 may be configured to interact with a mobile object 106, which may be any item that has the capacity to move. For example, the mobile object 106 may include an animal, such as a cat, a dog, a human, and/or the like. The mobile device 100 may be employed, for example, to exercise and/or entertain one or more animals (e.g., a cat, a dog, and/or a human). The mobile object 106 may include a second mobile device. The second mobile device may be similar to the mobile device 100.

This disclosure will now be described more fully with reference to the accompanying drawings, in which embodiments of this document are shown. This document should be read to include embodiments of many different forms and should not be construed as being limited to the embodiments set forth herein; rather, these embodiments are provided so that this disclosure will be thorough and complete, and will fully convey the concepts contained within this document to those of ordinary skill in the art.

Figure 1:
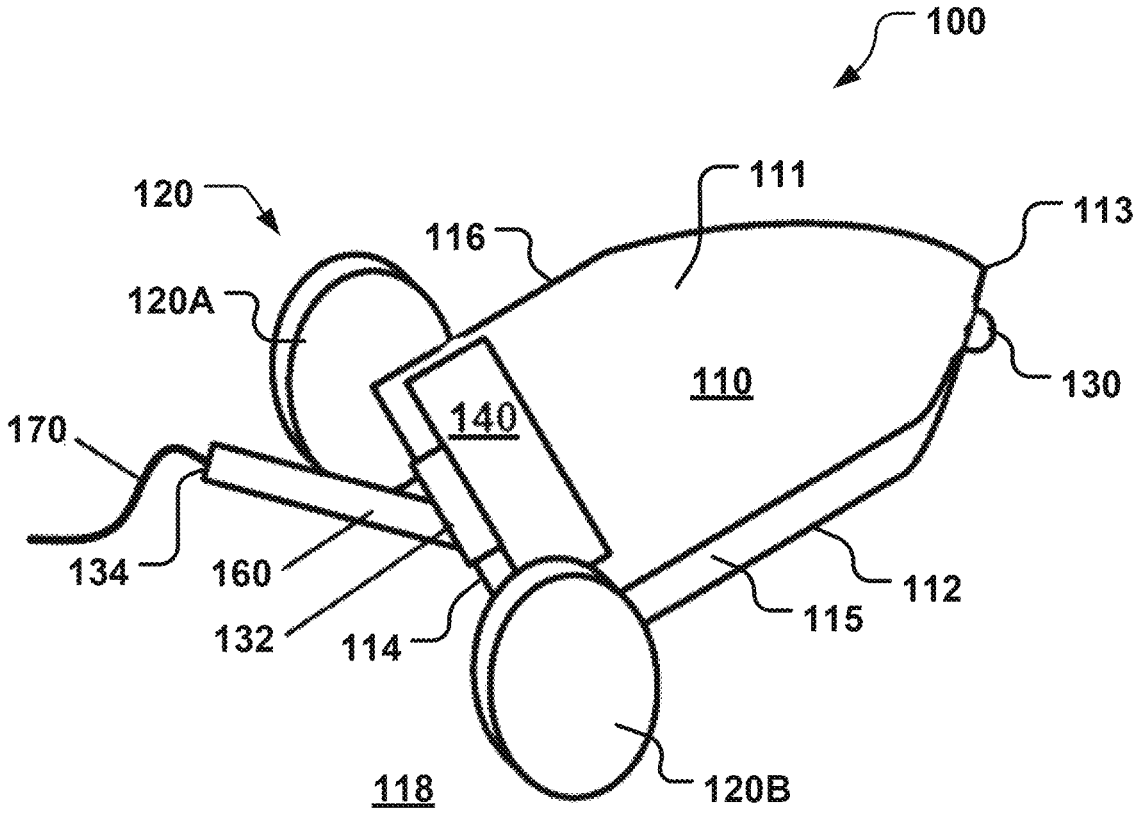
FIG. 1 is a diagram of a first embodiment of a mobile device with a mechanized tail.

FIG. 1 illustrates a first embodiment of the mobile device 100. Referring to FIG. 1, the mobile device 100 has a top portion 111 opposite a bottom portion 112, a front portion 113 opposite a back portion 114, and a left side portion 115 opposite a right side portion 116. Referring to FIG. 13, the mobile device 100 may include an onboard control mechanism 101, one or more sensors 102, one or more propulsion mechanisms 120, an energy source 124, a mobile device body or platform 110, a motion drive 140, and a member or mechanized tail 160.

While the mobile device 100 may be any size, in the figures and examples below, the mobile device 100 may be characterized as being toy sized. For example, the mobile device 100 may be small enough to fit within a box that is 30 centimeters ("cm") by 30 cm by 30 cm. By way of non-limiting examples, the mobile device 100 may have a length of about 7.5 cm, a width of about 5.8 cm, and a height of about 3.5 cm excluding the mechanized tail 160. By way of additional non-limiting examples, the mobile device 100 may have a length of about 9 cm, a width of about 5.8 cm, and a height of about 3.5 cm including the mechanized tail 160.

Control Mechanism

Referring to FIG. 13, the onboard control mechanism 101 is configured to control the motion drive 140 and the mechanized tail 160. The onboard control mechanism 101 may receive input (e.g., one or more electronic signals encoding sensor information) from each of the sensor(s) 102 and use this input when directing the motion drive 140 and/or the mechanized tail 160. The onboard control mechanism 101 may be configured to receive instructions (e.g., via one or more wireless link "L1") from the external system(s) 180. The onboard control mechanism 101 is configured to use these instructions to control the motion drive 140 and/or the mechanized tail 160.

The onboard control mechanism 101 may include circuitry 156, such as one or more processors 146, memory 148, a motion control circuit 144 (described below) of the motion drive 140, and a communications circuit 158. The circuitry 156 may include or be connected to an antenna 182 that facilitates wireless communication between the communications circuit 158 and the external system(s) 180. Optionally, the circuitry 156 may include or be connected to at least one of the sensor(s) 102, one or more actuators 122 (described below), the energy source 124, the antenna 182, a beacon 152 (described below), and a charging port 123 (described below).

The processor(s) 146 may be implemented as a microprocessor produced by microprocessor manufacturers such as Advanced Micro Devices, Inc. (AMD) of Sunnyvale, Calif., Atmel Corporation of San Jose, Calif., Intel Corporation of Santa Clara, Calif., or Texas Instruments Inc. of Dallas, Tex. The processor(s) 146 may include and/or be other logic-based controllers such as field-programmable gate arrays ("FPGAs") or programmable logic controllers ("PLCs").

The memory 148 may include nonvolatile memory configured to store processing instructions. Examples of memory that may be used to implement the memory 148 include read-only memory ("ROM"), electrically erasable programmable read-only memory ("EEPROM"), Flash, a combination thereof, and/or the like. The memory 148 may include volatile memory such as, for example, random-access memory ("RAM"). Contained within the memory 148 may be instructions that, when executed, may cause the processor(s) 146 to activate the motion drive 140 and/or the mechanized tail 160. The memory 148 may include non-transitory media configured to store these instructions.

The communications circuit 158 may include circuitry configured to interface with other components (e.g., the processor(s) 146) contained on the mobile device 100. The communication circuit 158 may be configured to communicate (e.g., via the antenna 182) with the external system(s) 180, which are external to the mobile device 100. For example, the communications circuit 158 may send data to the external system(s) 180 concerning the mobile device 100, such as distance measurements, speed measurements, inertial measurements, a combination thereof, and/or the like. Further, the communications circuit 158 may be configured to receive (e.g., via the antenna 182) wireless instructions from the external system(s) 180 that may direct the movement of the mobile device 100.

Sensor(s)

Referring to FIG. 13, the sensor(s) 102 include one or more navigation sensors 104A configured to help implement autonomous navigation. The navigation sensor(s) 104A may be positioned on the top portion 111 (see FIG. 1) and/or the front portion 113 (see FIGS. 1 and 2) of the mobile device 100. The navigation sensor(s) 104A may include an upward-facing proximity sensor and/or a forward-facing Time of Flight ("ToF") sensor. The navigation sensor(s) 104A may each be disposed in a housing (not shown) that includes infrared-transparent window(s).

The navigation sensor(s) 104A may send signals to the onboard control mechanism 101 encoding navigation information. The onboard control mechanism 101 may use this navigation information to direct the operations of the motion drive 140 when implementing autonomous navigation. However, when the mobile device 100 is positioned in an undesired orientation (e.g., upside-down), the navigation information may be inaccurate or insufficient, which may prevent the onboard control mechanism 101 from implementing autonomous navigation.

The sensor(s) 102 include an inertial measurement device 104B configured to help determine an orientation of the mobile device 100. Referring to FIG. 13, the platform 110 may house the inertial measurement device 104B. As mentioned above, the inertial measurement device 104B may be used to determine the orientation (e.g. right-side up, upside down, sideways, and the like) of the mobile device 100. The inertial measurement device 104B may include, for example, a device configured to measure changes in acceleration, magnitude, and/or direction. By way of non-limiting examples, the inertial measurement device 104B may be implemented as an accelerometer and/or a gyroscope configured to measure changes in acceleration of the mobile device 100. This information may be used by the onboard control mechanism 101 to determine the orientation of the mobile device 100, collisions, unlevel terrain, other types of interactions that the mobile device 100 may have with the environment, a combination thereof, and/or the like.

The sensor(s) 102 may include one or more encoders 104C (e.g., wheel encoders) coupled to the propulsion mechanism(s) 120 (e.g., drive wheels 120A and 120B illustrated in FIG. 1). The encoder(s) 104C may be mounted on the platform 110 and/or the propulsion mechanism(s) 120. The encoder(s) 104C is/are configured to provide information to the onboard control mechanism 101 that may be utilized, at least in part, by the processor(s) 146 and/or one or more external systems 180 to determine operating parameters of the mobile device 100, such as distance, speed, acceleration, combination thereof, and/or the like.

Propulsion Mechanism(s)

Referring to FIG. 1, the propulsion mechanism(s) 120 propel the mobile device 100. By way of non-limiting examples, the propulsion mechanism(s) 120 may be implemented as drive wheels (e.g., the drive wheels 120A and 120B), flopping wheels, tracks, plungers, legs, magnets, compressed air, a combination thereof, and/or the like. The propulsion mechanism(s) 120 may be mounted on the platform 110.

One or more stabilizing structures 130 may be positioned to balance the movement of the mobile device 100. By way of non-limiting examples, the stabilizing structure(s) 130 may be implemented as a wheel, a nub, a spherically shaped plastic piece, and the like. The stabilizing structure(s) 130 may be positioned such that when the mobile device 100 is tipped onto its front portion 113, the stabilizing structure(s) 130 is/are lifted off a driving surface 118 (e.g., a floor, the ground, and the like).

Figure 2:
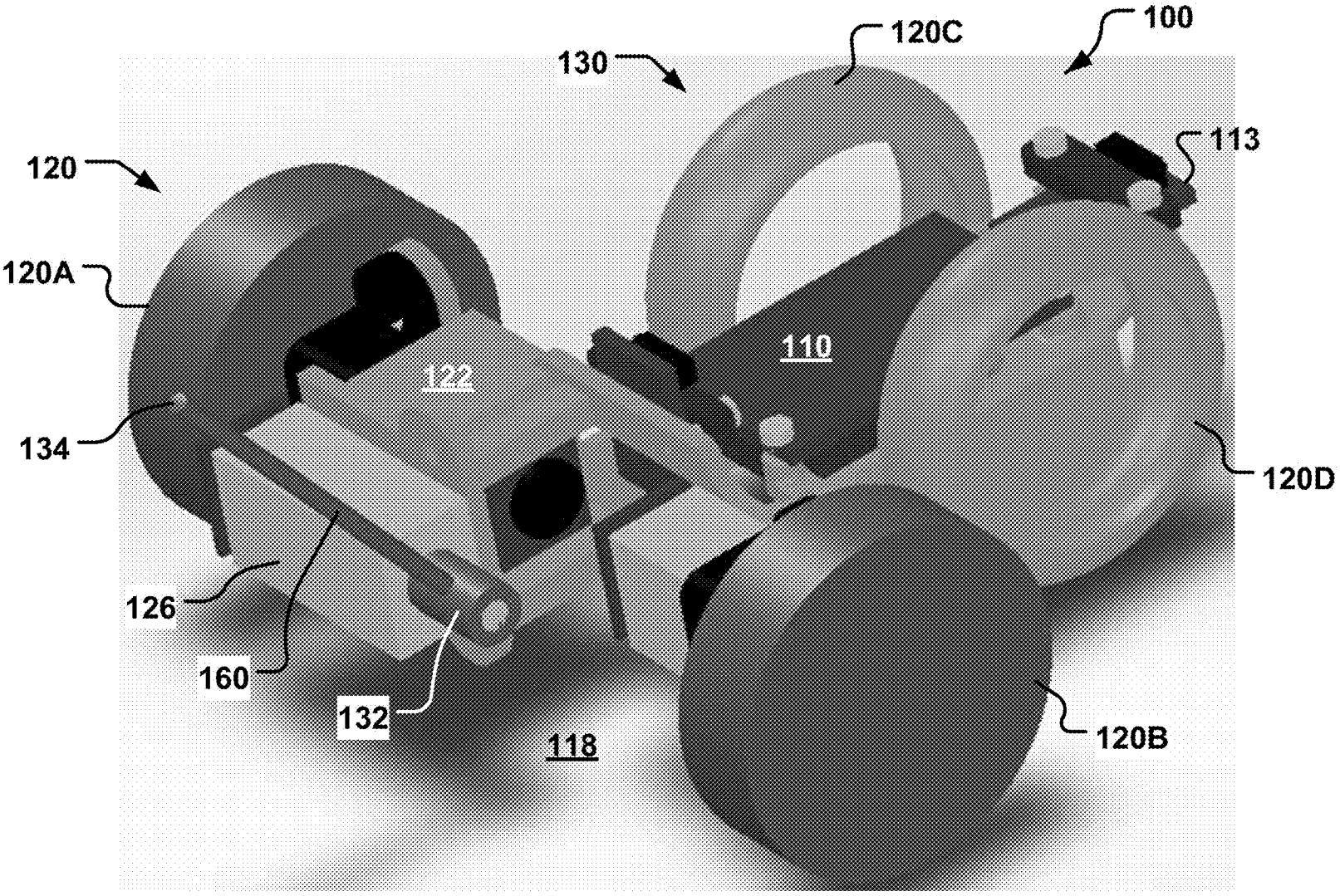
FIG. 2 is a rear perspective view of a second embodiment of the mobile device with the mechanized tail.

In the embodiment illustrated in FIG. 2, the mobile device 100 may include one or more free turning or non-drive wheels (e.g., non-drive wheels 120C and 120D). The non-drive wheels 120C and 120D may function as the stabilizing structure(s) 130 in this embodiment. The non-drive wheels 120C and 120D are positioned such that when the mobile device 100 is tipped onto its front portion 113, the non-drive wheels 120C and 120D are lifted off the driving surface 118.

Energy Source

Referring to FIG. 13, the energy source 124 is configured to supply power to various components (e.g., the motion drive 140, the onboard control mechanism 101, the actuator(s) 122, and the like). The energy source 124 may be implemented as battery. By way of a non-limiting example, the battery may rechargeable (e.g., via USB charging). In such embodiments, the mobile device 100 may include the charging port 123 (e.g., a USB connector), such as the type used by a cellular phone or tablet. An external charging cradle 125 may be coupled to the mobile device 100 (e.g., to the charging port 123) and used to charge the energy source 124.

Platform

Other components of the mobile device 100 are mounted on the platform 110. For example, the onboard control mechanism 101, the sensor(s) 102, the propulsion mechanism(s) 120, the energy source 124, the motion drive 140, and the mechanized tail 160 may all be mounted on or attached to the platform 110. Referring to FIG. 1, in the embodiments illustrated in the drawings, the platform 110 is supported above the driving surface 118 by the propulsion mechanism(s) 120 and, optionally, by the stabilizing structure(s) 130 (e.g., the non-drive wheels 120C and 120D illustrated in FIG. 2).

Figure 3:
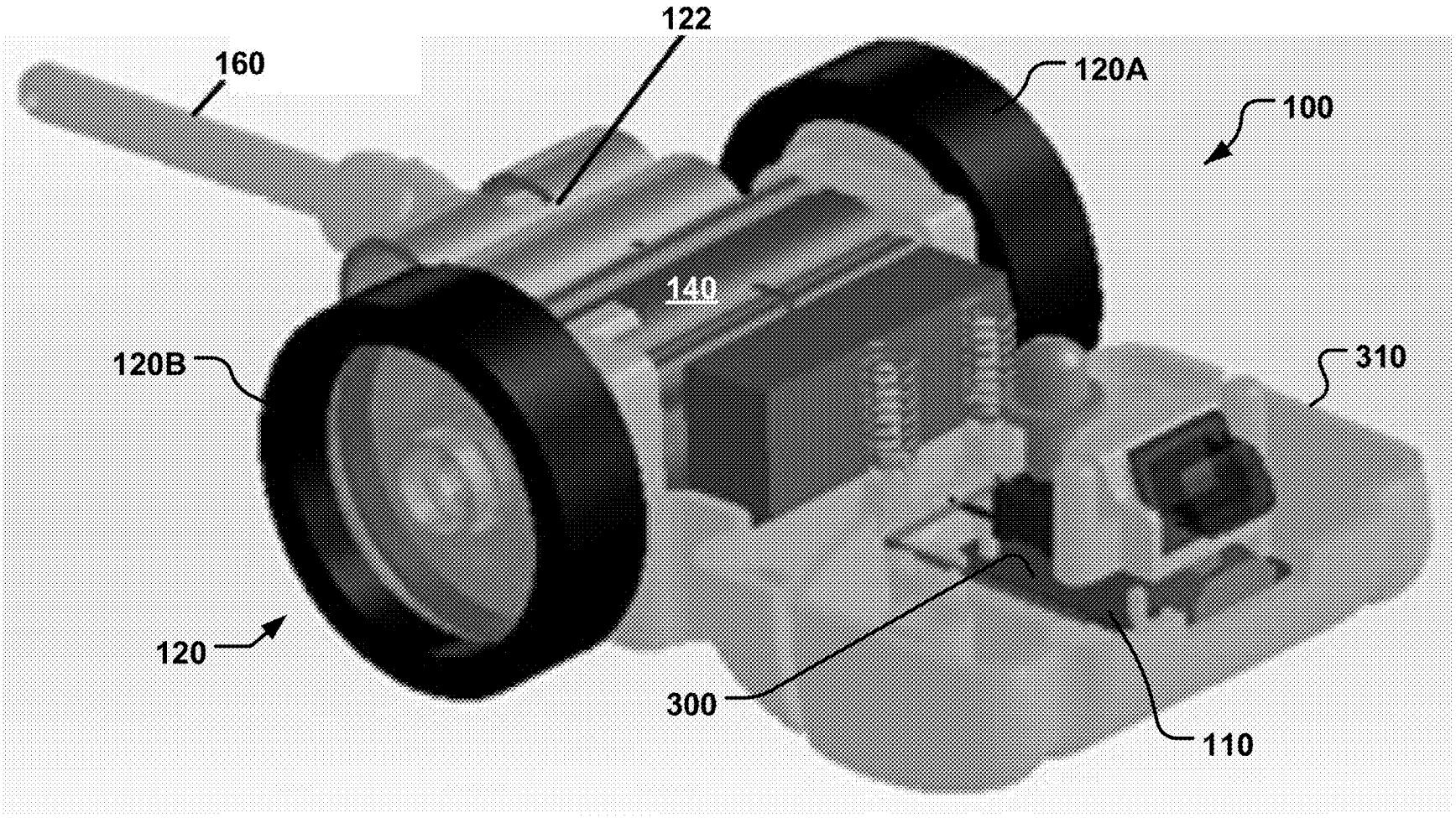
FIG. 3 is a front perspective view of a third embodiment of the mobile device with the mechanized tail.

Referring to FIG. 3, the platform 110 may be two and/or three-dimensional. The platform 110 may include a surface 300 upon which the onboard control mechanism 101 (see FIG. 13) may be disposed. For example, the platform 110 may be implemented as an insulated sheet and/or a type of circuit board. The platform 110 may include a body portion (not shown) as well as a frame (not shown) and/or a support mechanism (not shown) to which the body portion (not shown) is attached. Referring to FIG. 3, the platform 110 may include a plastic casing 310 and the propulsion mechanism(s) 120 (e.g., the drive wheels 120A and 120B) may reside on opposite sides of the casing 310. In such embodiments, the motion drive 140 and the mechanized tail 160 may be mounted on the casing 310 and may be connected to the onboard control mechanism 101 (see FIG. 13) by conductors (not shown), such as wires.

Referring to FIG. 13, the platform 110 may house or support the beacon 152 powered by the energy source 124. The beacon 152 may emit an electromagnetic signal 190. The electromagnetic signal 190 may include a modulated wave or synchronized oscillations of electric and magnetic fields. Examples of electromagnetic signals that may be used to implement the electromagnetic signal 190 include an ultraviolet signal, a visible light signal, an infrared signal, a radio wave spectrum signal, a radio frequency ("RF") signal, a combination thereof, and/or the like. The electromagnetic signal 190 emitted by the beacon 152 may allow an external imaging device 184 to detect the mobile device 100.

Motion Drive

Referring to FIG. 13, the motion drive 140 may be configured to receive navigation instructions (from the onboard control mechanism 101) and to propel the platform 110 according to the navigation instructions. To accomplish this movement, the motion drive 140 may include or be connected to the energy source 124 (see FIG. 13). The motion drive 140 may include one or more motors 142 controlled by one or more control mechanisms (e.g., the motion control circuit 144). The motor(s) 142 may be implemented as one or more direct current ("DC") motor(s) and/or one or more alternating current ("AC") motors. The energy source 124 supplies electricity to the motor(s) 142 and the control mechanisms (e.g., the motion control circuit 144). By way of a non-limiting example, the motion control circuit 144 may include an H bridge. The motion drive 140 may propel the platform 110 using the propulsion mechanism(s) 120. In other words, the motion drive 140 powers or drives the propulsion mechanism(s) 120.

Figure 5:
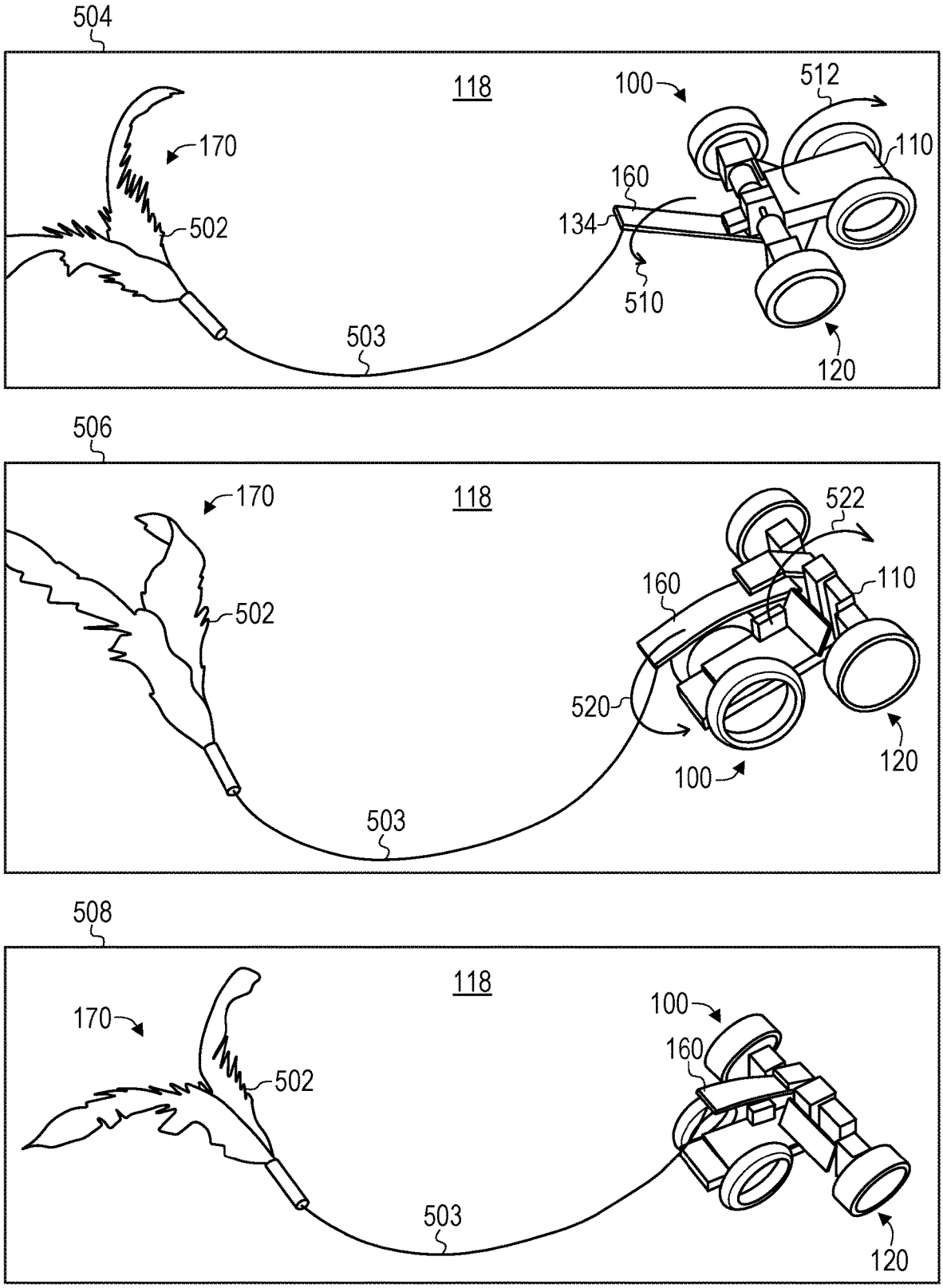
FIG. 5 is a series of three photographs depicting the second embodiment of the mobile device employing its mechanized tail to perform a front flip to right itself.
Figure 8:
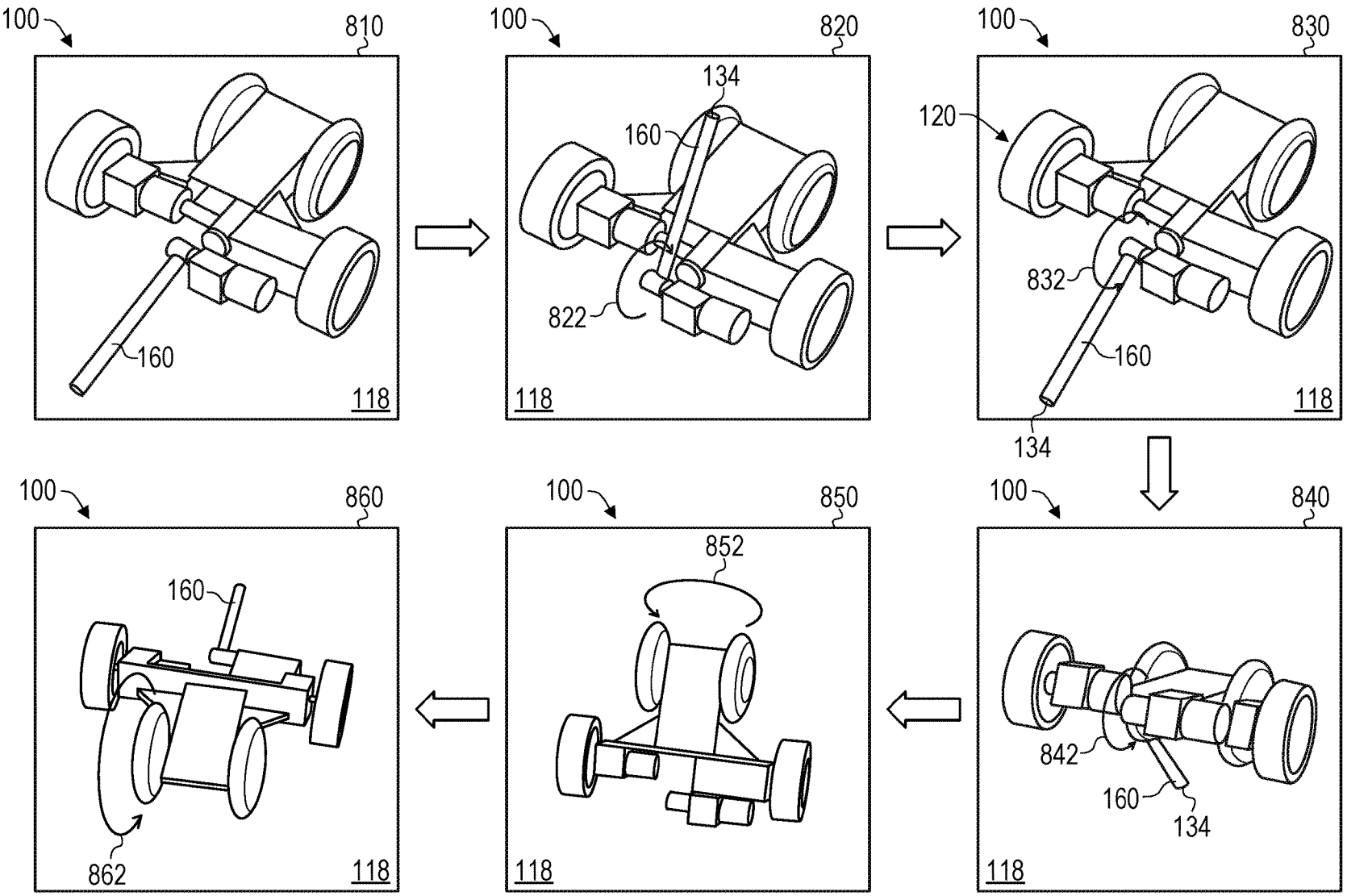
FIG. 8 is a series of six photographs depicting the second embodiment of the mobile device employing its mechanized tail to perform a back flip to right itself.

Referring to FIG. 1, in terms of operation, the platform 110 and the propulsion mechanism(s) 120 (e.g., the drive wheels 120A and 120B) may be configured to allow the mobile device 100 to remain mobile even when the mobile device 100 is in a flipped or undesired orientation (see a top photograph 504 of FIG. 5 and a first photograph 810 of FIG. 8). That is, the motion drive 140 may be configured to keep the mobile device 100 functional and to propel the platform 110 even when the platform 110 is in the undesired orientation. However, as explained below, the mobile device 100 may not be configured for autonomous navigation in the undesired orientation.

Mechanized Tail

Referring to FIG. 1, the mechanized tail 160 is mounted on the back portion 114 of the mobile device 100. The mechanized tail 160 is configured to help maintain and/or change the orientation of the mobile device 100 with respect to the driving surface 118. The mechanized tail 160 may be employed, for example, to right the mobile device 100, to assist the mobile device 100 when navigating uneven terrain, to assist the mobile device 100 when navigating slippery terrain, to help prevent the mobile device 100 from losing balance, to assist the mobile device 100 in orienting itself, combinations thereof, and/or the like.

The mechanized tail 160 has a base portion 132 that is pivotably coupled to the back portion 114 of the mobile device 100. The mechanized tail 160 has a free end portion or tip 134 opposite the base portion 132. The base portion 132 is configured to pivot with respect to the back portion 114 and position the tip 134 with respect to the driving surface 118. For example, the base portion 132 may be pivoted in first and second directions. The first direction is different from (e.g., opposite) the second direction. The first direction may move the tip 134 toward the driving surface 118 and/or the front portion 113 and the second direction may move the tip 134 away from the driving surface 118 and/or the front portion 113. The tip 134 may be positioned on and pressed against the driving surface 118 to thereby cause the mechanized tail 160 to lift the propulsion mechanism(s) 120 above the driving surface 118. By way of another non-limiting example, the tip 134 may be positioned above the driving surface 118 and/or above the top portion 111 of the mobile device 100. The mechanized tail 160 may be configured to lift and/or flip the mobile device 100. By way of a non-limiting example, the mechanized tail 160 may be configured to lift the platform 110 over an obstruction. The mechanized tail 160 may be configured to make motions configured to attract the attention of the mobile object (see FIG. 13). The mechanized tail 160 may be made of any suitable material(s) including, but not limited to metal, plastic, wood, food, combinations thereof, and/or the like.

Referring to FIG. 13, the mechanized tail 160 may be employed in one or more novel processes to play with, and/or exercise, cats and other animals. The mechanized tail 160 may be used to flick other objects, such as for example, feathers through the air. Tests indicate this is a huge hit amongst cats. Optionally, the mobile device 100 may include one or more tail attachments 170. The tail attachment(s) 170 may include feathers, food, treats, lights, textured materials, combinations thereof, and/or the like. The mechanized tail 160 may be configured to flick the tail attachment(s) 170 through the air for the purposes of entertaining the mobile object 106 (e.g., a cat). The tail attachment 170 may be employed to entice the attention of the mobile object 106, such as a cat. The mechanized tail 160 and/or the tail attachment 170 may be a string but may also include various colors, noise makers (such as a bell), food items, snacks, other attention generating items, a combination thereof, and/or the like.

Referring to FIG. 1, while the mobile device 100 may be physically capable in operating (e.g., driving) in multiple orientations, the mobile device 100 may be configured for autonomous navigation only in a desired orientation (e.g., right-side up). If the navigation sensor(s) 104A (see FIG. 13) enable autonomous navigation only when the mobile device 100 is in the desired orientation, the mechanized tail 160 may be used help reposition the mobile device 100 when the orientation of the mobile device 100 has changed to an undesired orientation (e.g., upside-down). For example, if the navigation sensor(s) 104A (see FIG. 13) is/are positioned on the top portion 111 and/or the front portion 113 of the mobile device 100, the mobile device 100 may only operate (e.g., drive) autonomously only in the right-side up configuration. Without the mechanized tail 160, the mobile device 100 would require additional sensors (not shown) configured to enable autonomous navigation in other orientations, which may increase the cost of the mobile device 100 (e.g., by an amount greater than the cost of including the mechanized tail 160). However, through application of ordinary skill in the art to the present teachings, embodiments in which the navigational sensors 104A includes sensors positioned on the top and front portions 111 and 113 as well as on at least one of the bottom, back, left side, and right side portions 112, 114, 115, and 116 may be constructed.

Referring to FIG. 13, by way of a non-limiting example, the mobile device 100 may be placed in the undesired orientation (e.g., upside-down) by the mobile object 106 (e.g., an enthusiastic cat) and/or by crashing into another object in the environment. Referring to FIG. 1, by way of a non-limiting example, the undesired orientation may include the mobile device 100 being positioned on either the left side portion 115 or the right side portion 116. The mechanized tail 160 may help keep the mobile device 100 in a desired orientation (e.g., right-side up).

Referring to FIG. 13, the actuator(s) 122 may be employed to move and/or control the mechanized tail 160. The actuator(s) 122 may respond to a control signal (e.g., received from the onboard control mechanism 101). When the control signal is received from the onboard control mechanism 101, the actuator(s) 122 may respond by converting energy from the energy source 124 into mechanical motion. Examples of actuators that may be used to implement the actuator(s) 122 include: motors, solenoids, hydraulic cylinders, bi-metal, artificial muscles and piezoelectric actuators. The actuator(s) 122 may be connected to the mechanized tail 160 by gearing mechanisms or a gear box 126.

The actuator(s) 122 may include or be connected to a quadrature encoder 150. The onboard control mechanism 101 is configured to provide instructions to the quadrature encoder 150 that directly control speed, direction, and position of the mechanized tail 160. The quadrature encoder 150 allows the onboard control mechanism 101 to plan (or receive such plans from the external system(s) 180) and execute specific travel paths through which the mechanized tail 160 may move. This is useful when the user 162 has placed at least one of the tail attachment(s) 170 on the mechanized tail 160. For example, referring to FIG. 1, the tail attachment(s) 170 may be implemented as a string that is attached to the mechanized tail 160 (e.g., near the tip 134) and the quadrature encoder 150 (see FIG. 13) may be used to generate a quick "flicking" action or motion that causes the string to sail through the air. By way of another example, the tail attachment(s) 170 may include a feather attached to the mechanized tail 160 by a spring steel wire. This type of attachment may be designed to be held in place at a predetermined angle relative to the driving surface 118 and the quadrature encoder 150 (see FIG. 13) may use slower movements to move the attachment (instead of the quick flicks used to move the string).

The mechanized tail 160 may be employed to stabilize the mobile device 100. For example, the mechanized tail 160 may be configured as an active stabilization device while the mobile device 100 is moving (e.g., driving). The mechanized tail 160 may be configured to touch the driving surface 118 at various locations to prevent the mobile device 100 from flipping over while turning, accelerating, braking, and/or performing other maneuvers. This kind of configuration may enable the mobile device 100 to navigate, for example, various terrains and slippery conditions.

The mechanized tail 160 may be configured to adjust the center of gravity of the mobile device 100. This may assist the mobile device 100 to reorient itself in mid-air. For example, if the mobile device 100 drives off a ramp and/or is tilted too much, the mechanized tail 160 may be employed as a variable counter-weight, allowing the mobile device 100 to twist and right the mobile device 100 mid-air.

Remote Control Device

Referring to FIG. 13, the external system(s) 180 may include a remote control device 186 (e.g., a computing device) configured to remotely control the mobile device 100. The user 162 may direct the movement of the mobile device 100 based on visual information provided to the user 162 on a screen display 192 of the remote control device 186. The user 162 may provide an input (e.g., a selection) to a user interface 194 of the remote control device 186 and specify a final location for the mobile device 100 to move. The user interface 194 may be implemented as a computer peripheral device (e.g., a mouse, a touch screen display, and the like). By way of non-limiting examples, the user 162 may provide the input by clicking the mouse and/or tapping on the touch screen display. The user 162 may potentially shift the area displayed on the screen display 192, allowing the user 162 to make a final location selection beyond the initial frame shown.

The user 162 may use the remote control device 186 to control the mechanized tail 160. The onboard control mechanism 101 may be configured to receive and follow commands received wirelessly (e.g., via Bluetooth). For example, the user 162 may enter commands into the remote control device 186 that the remote control device 186 transmits (e.g., using Bluetooth) to the mobile device 100. The commands may be received by the antenna 182 and forwarded thereby to the processor(s) 146. The processor(s) 146 interpret(s) the received commands and issue(s) instructions to any structures (e.g., the motor drive 140 and/or the actuator(s) 122) needed to implement the commands.

Alternate Embodiments

FIG. 2 is a rear perspective view of the mobile device 100 and its mechanized tail 160 as per a second embodiment of the present disclosure. In the example illustrated in FIG. 2, the mechanized tail 160 has been constructed from copper. The mechanized tail 160 may be coupled to the gear box 126. The gear box 126 may be driven by the actuator(s) 122. Referring to FIG. 13, the processor(s) 146 may control the operation of the actuator(s) 122. In the embodiment illustrated in FIG. 2, the mobile device 100 includes the single actuator 122, which is configured to control the operation of the gear box 126. The gear box 126 moves the mechanized tail 160.

FIG. 3 is a front perspective view of a third embodiment of the mobile device 100 with the mechanized tail 160. This illustration shows the mechanized tail 160 connected to the platform 110 via the single actuator 122. Referring to FIG. 13, the processor(s) 146 may control the operation of the single actuator 122. Referring to FIG. 3, in this embodiment, the gear box 126 (see FIGS. 2 and 13) has been omitted. The single actuator 122 is configured to control the operation of and move the mechanized tail 160.

Figure 4A:
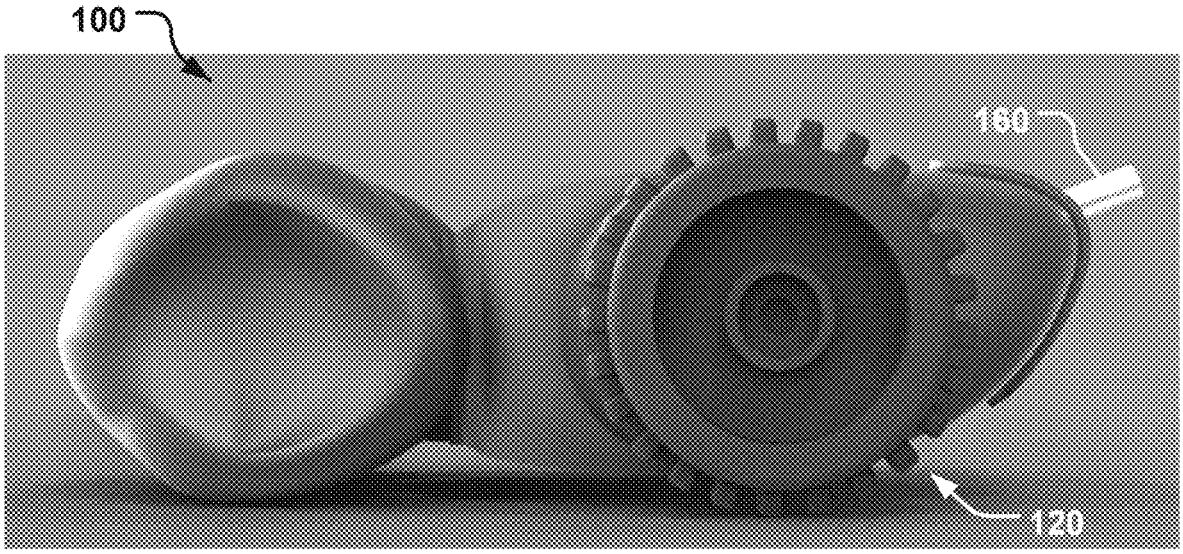
FIG. 4A is a side view of a fourth embodiment of the mobile device with the mechanized tail.
Figure 4B:
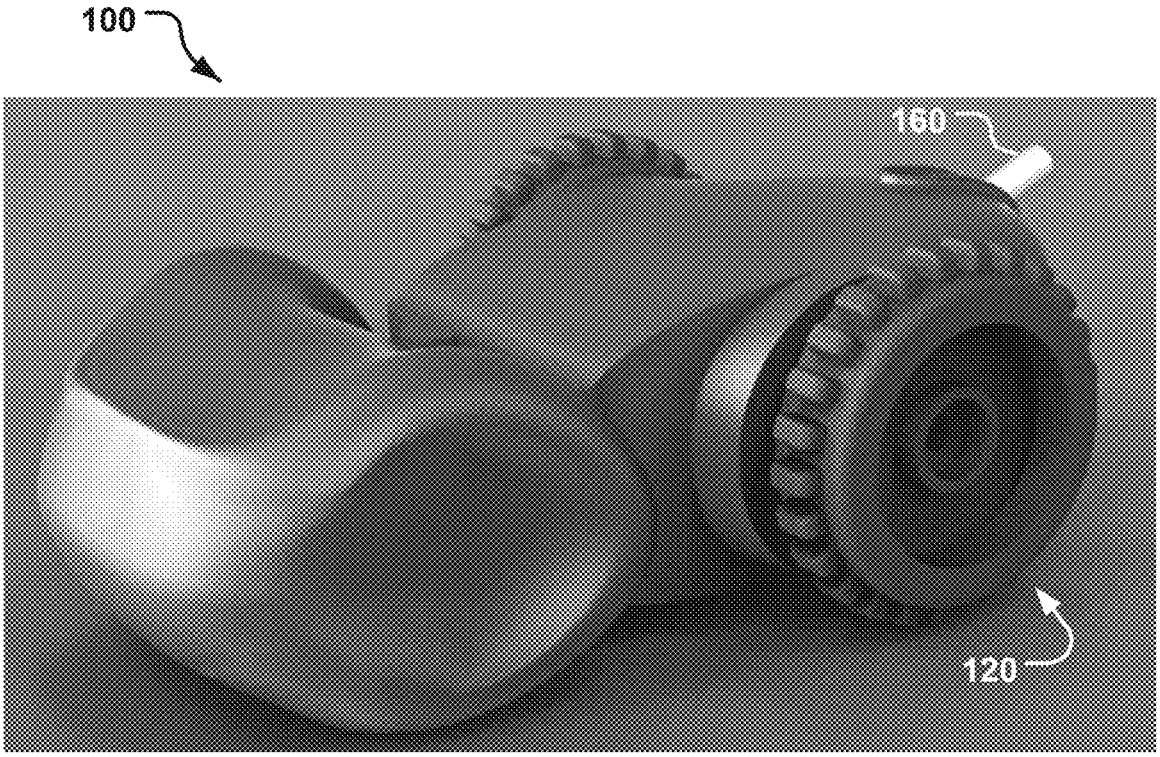
FIG. 4B is a front perspective view of the mobile device of FIG. 4A.
Figure 4C:
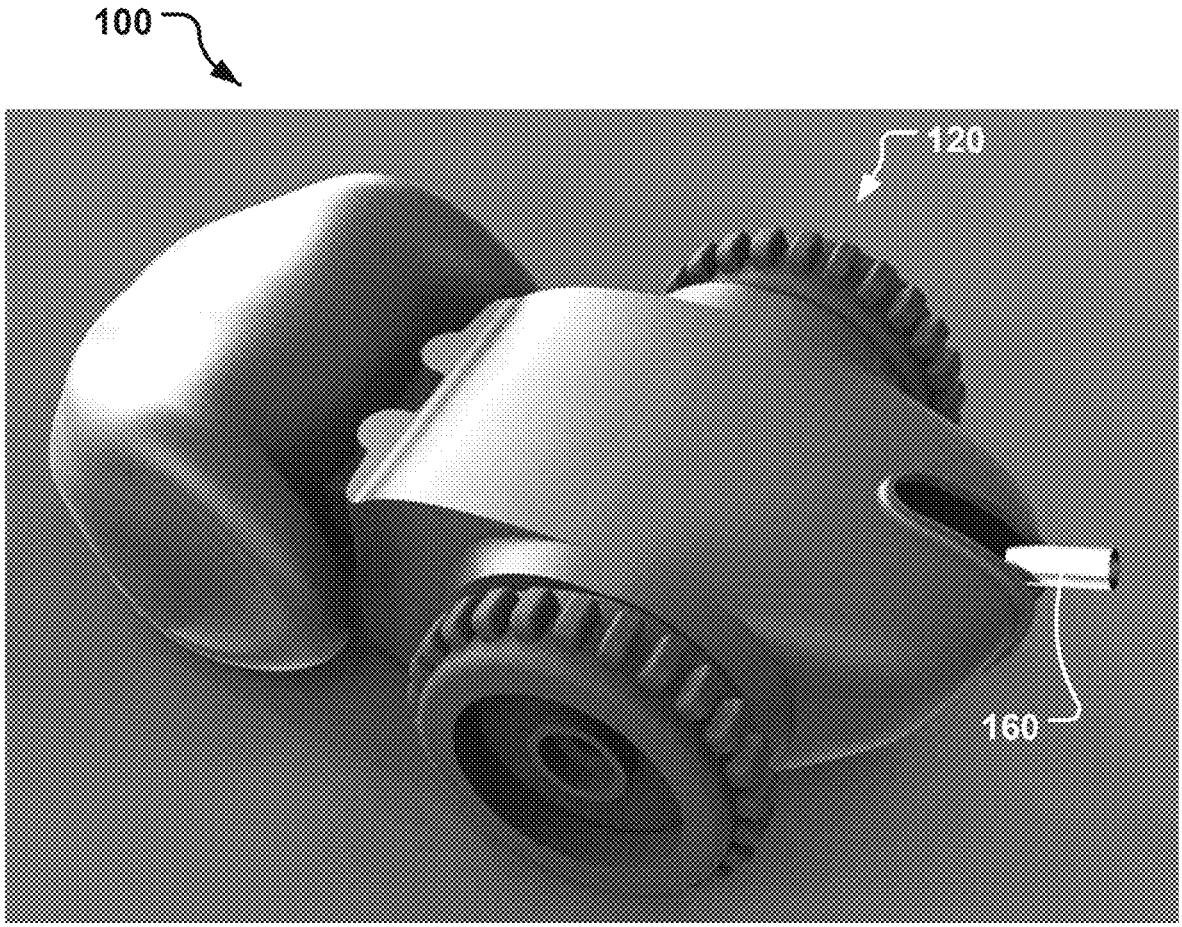
FIG. 4C is a rear perspective view of the mobile device of FIG. 4A.

FIGS. 4A-4C illustrate a fourth embodiment of the mobile device 100. FIG. 4A is a side view of the fourth embodiment of the mobile device 100 with the mechanized tail 160. FIG. 4B is a front perspective view of the fourth embodiment of the mobile device 100 with the mechanized tail 160. FIG. 4C is a rear perspective view of the fourth embodiment of the mobile device 100 with the mechanized tail 160.

Figure 14:
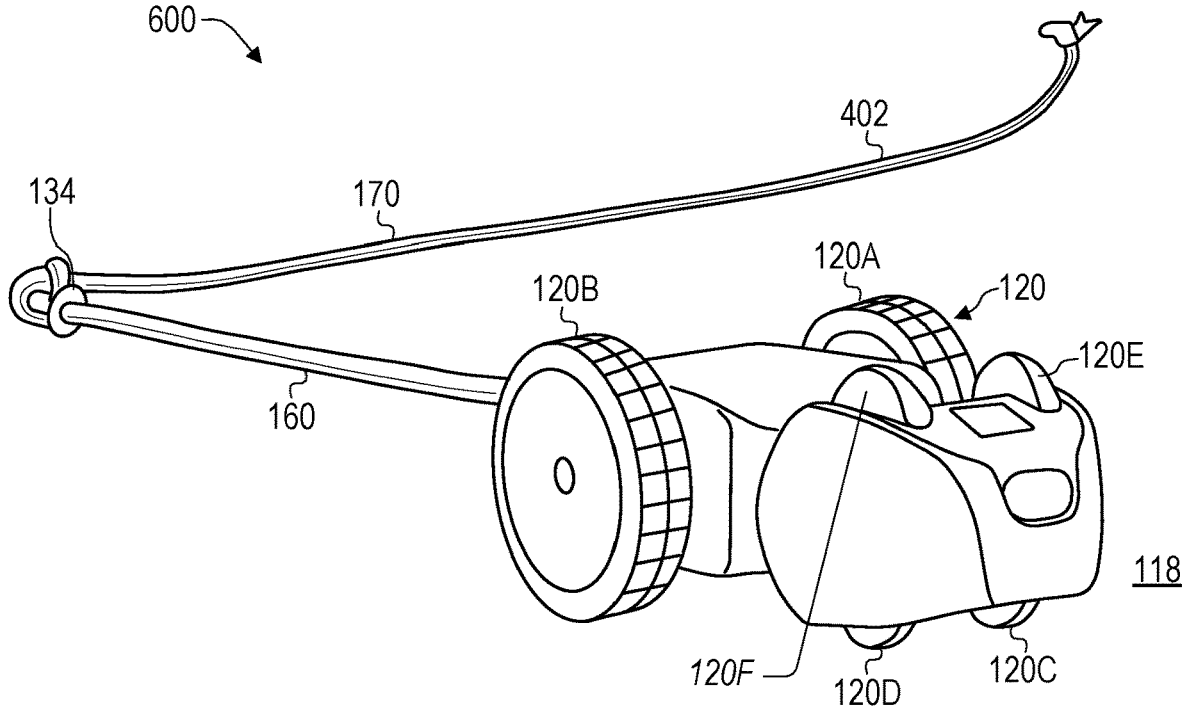
FIG. 14 is a front perspective views of a fifth embodiment of the mobile device illustrated with a cord attached to the mechanized tail.
Figure 15:
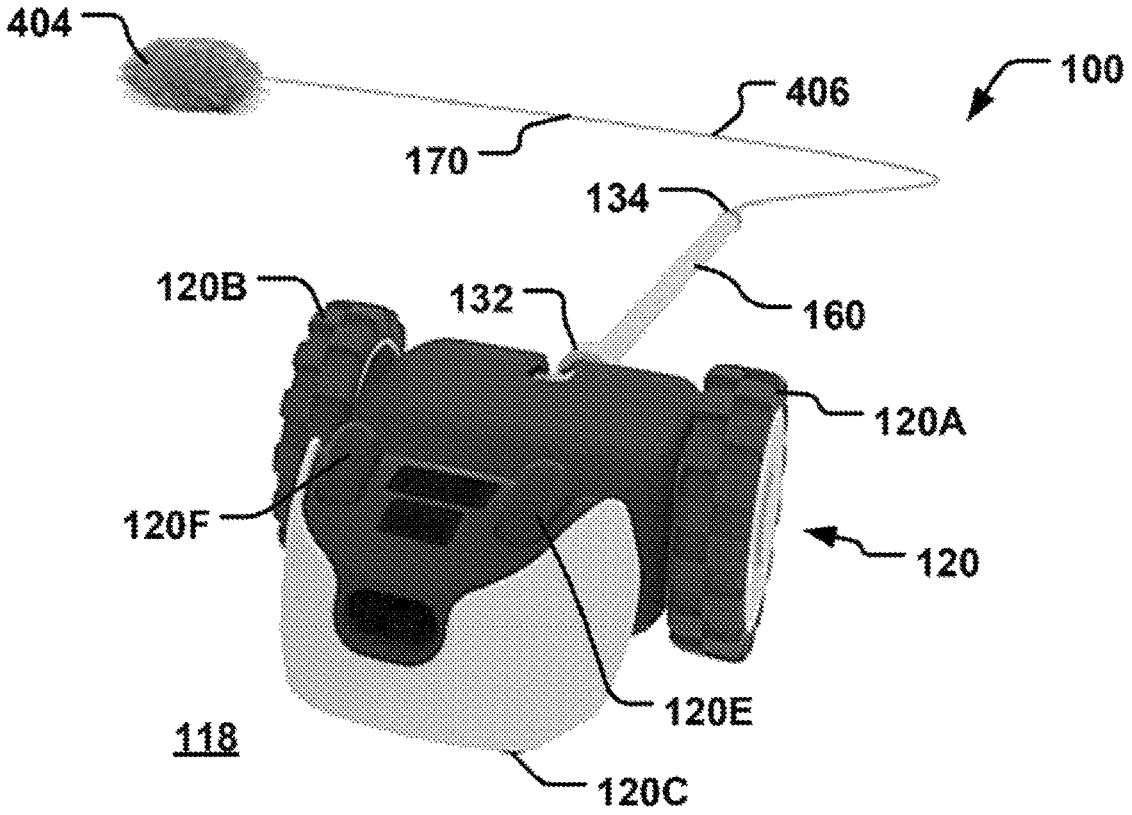
FIG. 15 is a front perspective views of the fifth embodiment of the mobile device illustrated with a toy tethered to the mechanized tail.

FIGS. 14 and 15 are both front perspective views of a fifth embodiment of the mobile device 100 in the right-side up orientation. In the embodiment illustrated in FIGS. 14 and 15, the mobile device 100 includes the non-drive wheels 120C and 120D, which are positioned on the driving surface 118 when the mobile device 100 is right-side up. In the right-side up orientation, the non-drive wheels 120C and 120D may function as the stabilizing structure(s) 130. The fifth embodiment also includes non-drive wheels 120E and 120F, which are positioned on the driving surface 118 when the mobile device 100 is upside down. In the upside down orientation, the non-drive wheels 120E and 120F may function as the stabilizing structure(s) 130. The non-drive wheels 120C-120F are positioned such that when the mobile device 100 is tipped onto its front portion 113, the non-drive wheels 120C-120F are lifted off the driving surface 118.

In FIGS. 14 and 15, the tail attachment(s) 170 is attached to the tip 134 of the mechanized tail 160. In FIG. 14, the tail attachment(s) 170 has been implemented as a string or cord 402. The mechanized tail 160 is configured to move the cord 402 around (e.g., to entertain the mobile object 106 illustrated in FIG. 13). The mechanized tail 160 may move the cord 402 as the mobile device 100 drives around the driving surface 118.

In FIG. 15, the tail attachment(s) 170 has been implemented as a toy 404 attached to the tip 134 of the mechanized tail 160 by a tether 406 (e.g., a string, a wire, a spring steel wire, and the like). In this embodiment, the mechanized tail 160 is configured to move the tether 406 and flip the toy 404 around (e.g., to entertain the mobile object 106 illustrated in FIG. 13). The mechanized tail 160 may move the tether 406 and flip the toy 404 around as the mobile device 100 drives around the driving surface 118.

Alternative embodiments may include utilizing multiple mobile devices to create a game. The game may be played on a tabletop or on the driving surface 118 (e.g., the ground). The game may involve user control of multiple mobile devices. Alternative embodiments may include utilizing mobile devices to entertain children and/or adults. Children and/or adults may chase mobile devices. Thus, the present embodiments should not be limited by any of the above described embodiments.

Front Flip Example

FIG. 5 is a series of three photographs 504-508 depicting the second embodiment of the mobile device 100 employing the mechanized tail 160 to perform a front flip to right itself. As illustrated, the mechanized tail 160 includes the tail attachment(s) 170, which has been implemented as a feather 502. The feather 502 is attached to the mechanized tail 160 near the tip 134 by a tether 503 (e.g., a string, a wire, a spring steel wire, and the like).

In the top photograph 504, the mobile device 100 is in the undesired orientation, which in this example is upside down. In the middle photograph 506, the mobile device 100 is moving toward the desired orientation, which in this example is right-side up. Finally, in the bottom photograph 508, the mobile device 100 is in the desired orientation (e.g., right-side up). The process by which the mechanized tail 160 transitions the mobile device 100 from the undesired orientation to the desired orientation will now be described started at the top photograph 504. The tip 134 of the mechanized tail 160 may move downwardly toward the driving surface 118 (e.g., in a motion illustrated by a curved arrow 510), contact the driving surface 118, and lift the propulsion mechanism(s) 120 of the mobile device 100 off the driving surface 118. This causes the back portion 114 (see FIG. 1) of the upside-down mobile device 100 to rotate forwards (e.g., in a motion illustrated by a curved arrow 512). Referring to a middle photograph 506, the tip 134 of the mechanized tail 160 may continue moving (e.g., in a motion illustrated by a curved arrow 520) toward the front portion 113 (see FIGS. 1 and 2) of the upside-down mobile device 100. This movement cause the mobile device 100 to rotate (e.g., in a motion illustrated by a curved arrow 522) about the front portion 113 (see FIGS. 1 and 2) of the mobile device 100 into the desired orientation, which in this example is a righted or right-side up position. Finally, the platform 110 may come to rest in the desired orientation as illustrated in the bottom photograph 508.

Attention Getting Motion Example

Figure 6:
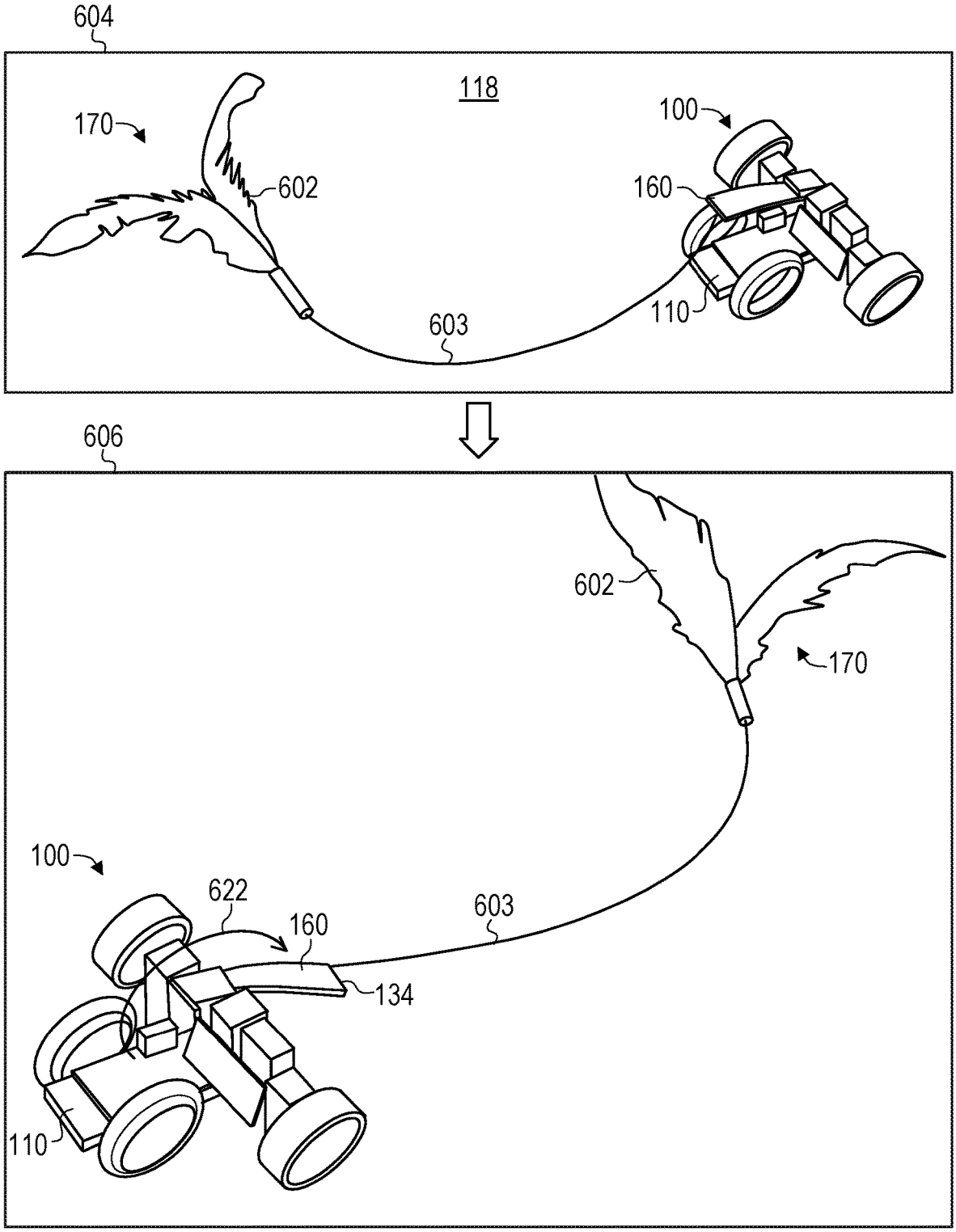
FIG. 6 is a series of two photographs depicting the second embodiment of the mobile device employing its mechanized tail to make an attention getting motion.

FIG. 6 is a series of two photographs 604 and 608 depicting the second embodiment of the mobile device 100 employing the mechanized tail 160 to make an attention getting motion. The mobile device 100 is in the desired orientation in both of the photographs 604 and 606. As illustrated, the mechanized tail 160 has the tail attachment(s) 170, which has been implemented as a feather 602. Referring to the bottom photograph 606, the feather 602 is attached to the mechanized tail 160 near the tip 134 by a tether 603 (e.g., a string, a wire, a spring steel wire, and the like). The tip 134 of the mechanized tail 160 may move or rotate backwardly (e.g., in a motion illustrated by a curved arrow 622) to cause the feather 602 to flip around. This motion may be considered a "flick." This and similar motions may be configured to get the attention of the mobile object 106 (see FIG. 13), such as a cat, dog, human, robot, combinations thereof, and/or the like.

Overcoming a Physical Obstacle Example

Figure 7:
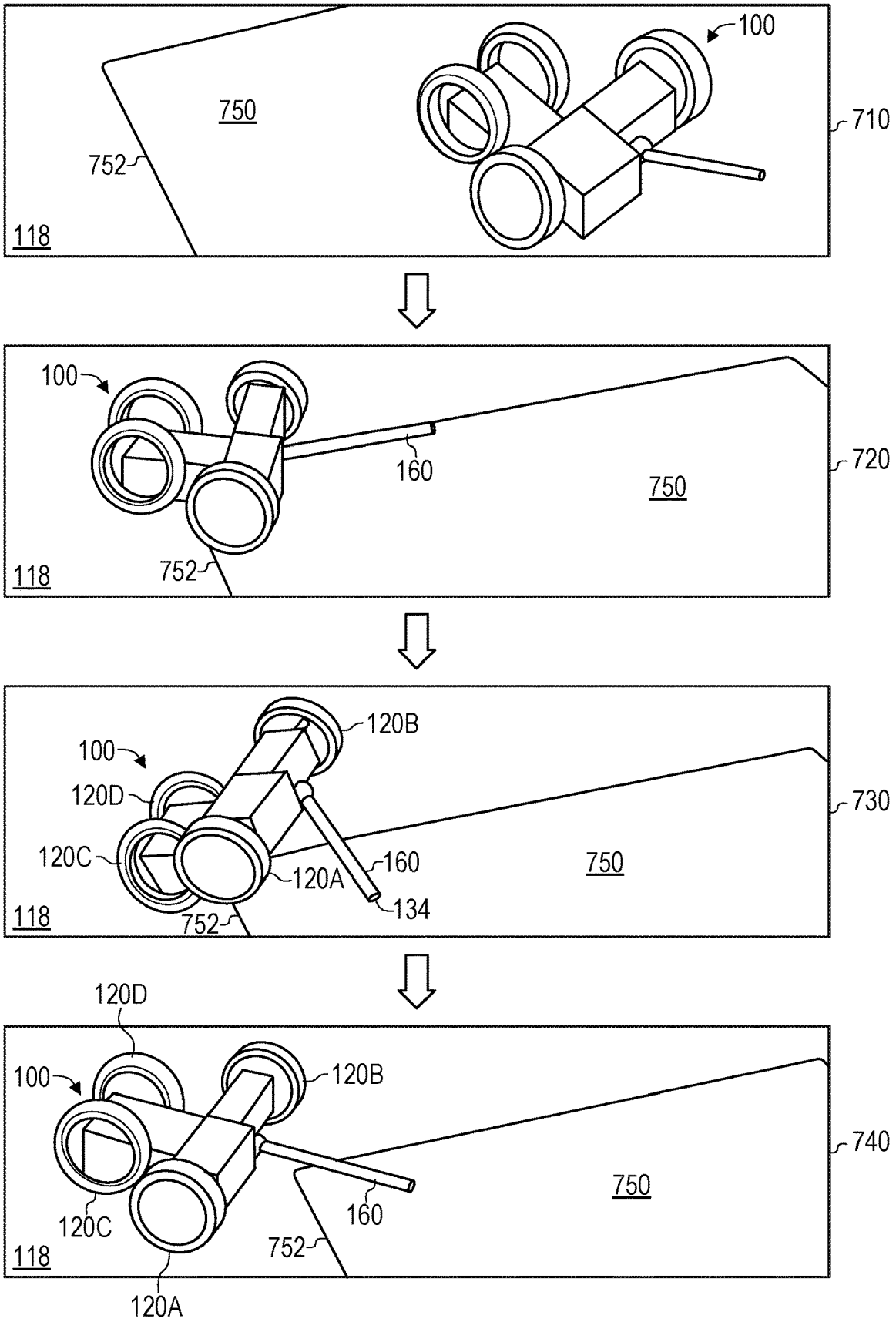
FIG. 7 is a series of four photographs depicting the second embodiment of the mobile device employing its mechanized tail to free itself after getting stuck on a carpet.

FIG. 7 is a series of four photographs 710-740, which illustrate the second embodiment of the mobile device 100 moving from right to left across a rug or carpet 750 positioned on the driving surface 118. As mentioned above, the mechanized tail 160 may assist the mobile device 100 when traversing an environment and actively avoid getting stuck on things, such as, for example, the edge (or periphery 752) of the carpet 750, cables, clothing, clutter, object(s) in the environment, combinations thereof, and/or the like. In FIG. 7, the mobile device 100 employs the mechanized tail 160 to free itself after getting stuck on the carpet 750. As mentioned above, referring to FIG. 2, in this embodiment, the propulsion mechanism(s) 120 include the drive wheels 120A and 120B and the stabilizing structure(s) 130 include the non-drive wheels 120C and 120D. The non-drive wheels 120C and 120D may be positioned nearer the front portion 113 (see FIGS. 1 and 2) of the mobile device 100 than the drive wheels 120A and 120B. Thus, the drive wheels 120A and 120B may be characterized as being rear wheels and the non-drive wheels 120C and 120D may be characterized as being front wheels.

Referring to the top photograph 710 of FIG. 7, the mobile device 100 is depicted moving or driving across the carpet 750. At the second photograph 720, the mobile device 100 becomes stuck at the periphery 752 of the carpet 750. Referring to the third photograph 730, the mobile device 100 may lift its rear wheels 120A and 120B up and off the carpet 750 by pivoting the tip 134 of the mechanized tail 160 in the first direction to thereby lower the tip 134 into contact with the carpet 750 and continuing to rotate the tip 134 in the same direction toward the front portion 113 (see FIGS. 1 and 2) until the rear wheels 120A and 120B are positioned above the carpet 750. Referring to FIG. 2, this also lifts the non-drive wheels 120C and 120D off the driving surface 118 and positions the mobile device 100 on its front portion 113. The weight of the mobile device 100 pushes the mobile device 100 forwardly on its front portion 113 and causes the mobile device 100 to lurch forward. Referring to the bottom photograph 740 of FIG. 7, as this occurs, the tip 134 of the mechanized tail 160 may be rotated upwardly away from the carpet 750 and the driving surface 118. The rear wheels 120A and 120B of the mobile device 100 may land past the periphery 752 of the carpet 750 and the mobile device 100 may continue moving along the driving surface 118.

Back Flip Example

FIG. 8 is a series of six photographs 810, 820, 830, 840, 850, and 860, which illustrate the second embodiment of the mobile device 100 employing the mechanized tail 160 to perform a back flip and flip itself from the undesired orientation (e.g., upside down) to the desired orientation (e.g., right-side up). Referring to the first photograph 810, the mobile device 100 may start in a nominal position. As mentioned above, in this example, the mobile device 100 starts in the undesired orientation (e.g., upside down). Then, in the photograph 820, the mobile device 100 may raise the tip 134 of the mechanized tail 160 (e.g., in a motion illustrated by a curved arrow 822).

Referring to the photograph 830, the mobile device 100 may move the tip 134 of the mechanized tail 160 in the first direction toward the driving surface 118 (e.g., in a motion illustrated by a curved arrow 832) with sufficient force to lift the propulsion mechanism(s) 120 of the mobile device 100 off the driving surface 118. Next, referring to the photograph 840, the tip 134 of the mechanized tail 160 continues to move in the first direction toward the front portion 113 (see FIGS. 1 and 2) of the mobile device 100 (e.g., in a motion illustrated by a curved arrow 842) causing the back portion 114 (see FIG. 1) of the mobile device 100 to fall backwardly toward the driving surface 118 and onto the mechanized tail 160.

In the photograph 850, the tip 134 of the mechanized tail 160 moves in the second direction (which may be opposite the first direction). This presses the tip 134 against the driving surface 118 and causes the front portion 113 (see FIGS. 1 and 2) of the mobile device 100 to lift up off the driving surface 118 and flip over the back portion 114 (see FIG. 1) of the mobile device 100 (e.g., in a motion illustrated by a curved arrow 852 in the photograph 850). Thus, while the mechanized tail 160 is being pivoted, the mechanized tail 160 may actually remain stationary until the mobile device 100 begins to flip. Finally, in the photograph 860, the mobile device 100 lands in the desired orientation (e.g., in a motion illustrated by a curved arrow 862).

Figure 9A:
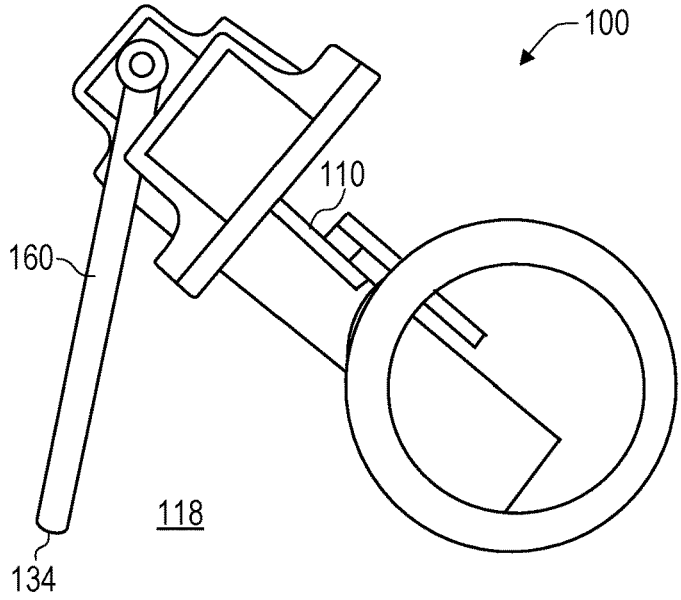
FIG. 9A is a side view of the mechanized tail of the second embodiment of the mobile device performing a first step of a back flip.
Figure 9B:
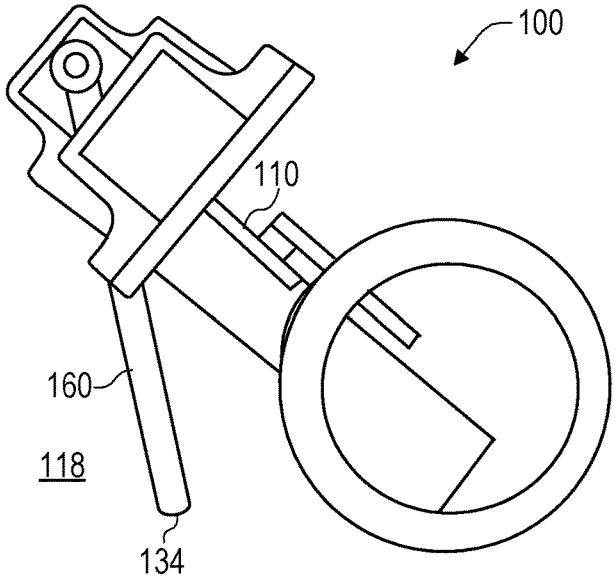
FIG. 9B is a side view of the mechanized tail of the second embodiment of the mobile device performing a second step of the back flip.

Generally speaking, the back flip illustrated in FIG. 8 involves two steps illustrated in FIGS. 9A and 9B. The propulsion mechanism(s) 120 (see FIGS. 1-5, 8, and 13-15) have been omitted from FIGS. 9A and 9B. Referring to FIG. 9A, the first step is moving the tip 134 in the first direction to tuck the tip 134 of the mechanized tail 160 underneath the mobile device 100 so the mobile device 100 rests fully on the mechanized tail 160. Referring to FIG. 9B, the second step is continuing to move the tip 134 of the mechanized tail 160 in the first direction toward the front portion 113 (see FIGS. 1 and 2) of the mobile device 100, which causes the back portion 114 (see FIG. 1) of the mobile device 100 to fall toward the driving surface 118 and onto the mechanized tail 160. After the second step, the tip 134 of the mechanized tail 160 may be moved in the second direction and pressed against the driving surface 118, which causes the front portion 113 (see FIGS. 1 and 2) of the mobile device 100 to lift up off the driving surface 118 and flip over the back portion 114 (see FIG. 1) of the mobile device 100.

Figure 10A:
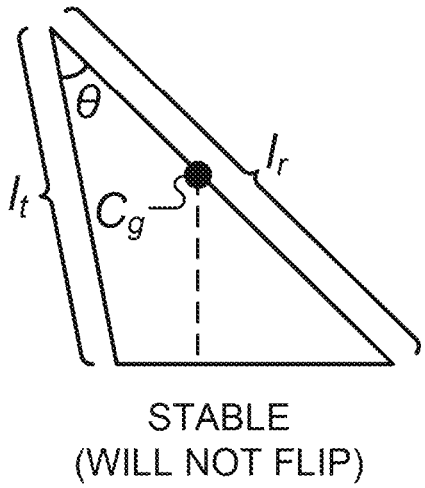
FIG. 10A is a geometric model of the mobile device illustrating a stable configuration in which the mobile device cannot perform either a front or back flip.
Figure 10B:
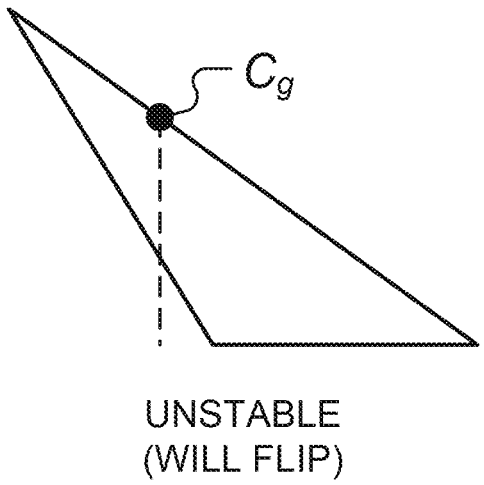
FIG. 10B is a geometric model of the mobile device illustrating an unstable configuration in which the mobile device can perform a back flip.

For the platform 110 to fall onto the mechanized tail 160 as it would in FIG. 9B, instead of resting stably on the mechanized tail 160 as it does in FIG. 9A, the center of gravity of the mobile device 100 may be outside the support created by the front portion 113 (see FIGS. 1 and 2) of the mobile device 100 and the tip of the mechanized tail 160. This is illustrated geometrically in FIGS. 10A and 10B. FIG. 10A illustrates an unstable configuration in which the mobile device 100 will perform a back flip and FIG. 10B illustrates a stable configuration in which the mobile device 100 will not perform the back flip. In FIGS. 10A and 10B, "$C_g$" represents a position of a center gravity of the mobile device 100 measured from the pivot at the base portion 132 (see FIGS. 1 and 2) of the mechanized tail 160. In FIG. 10A, "$l_t$" represents a length of the mechanized tail 160, "$l_r$" represents a length of the mobile device 100, and "θ" represents a minimum angle between the mechanized tail 160 and the platform 110. The minimum angle "θ" may be limited by the physical components of the mobile device 100.

Figure 11:
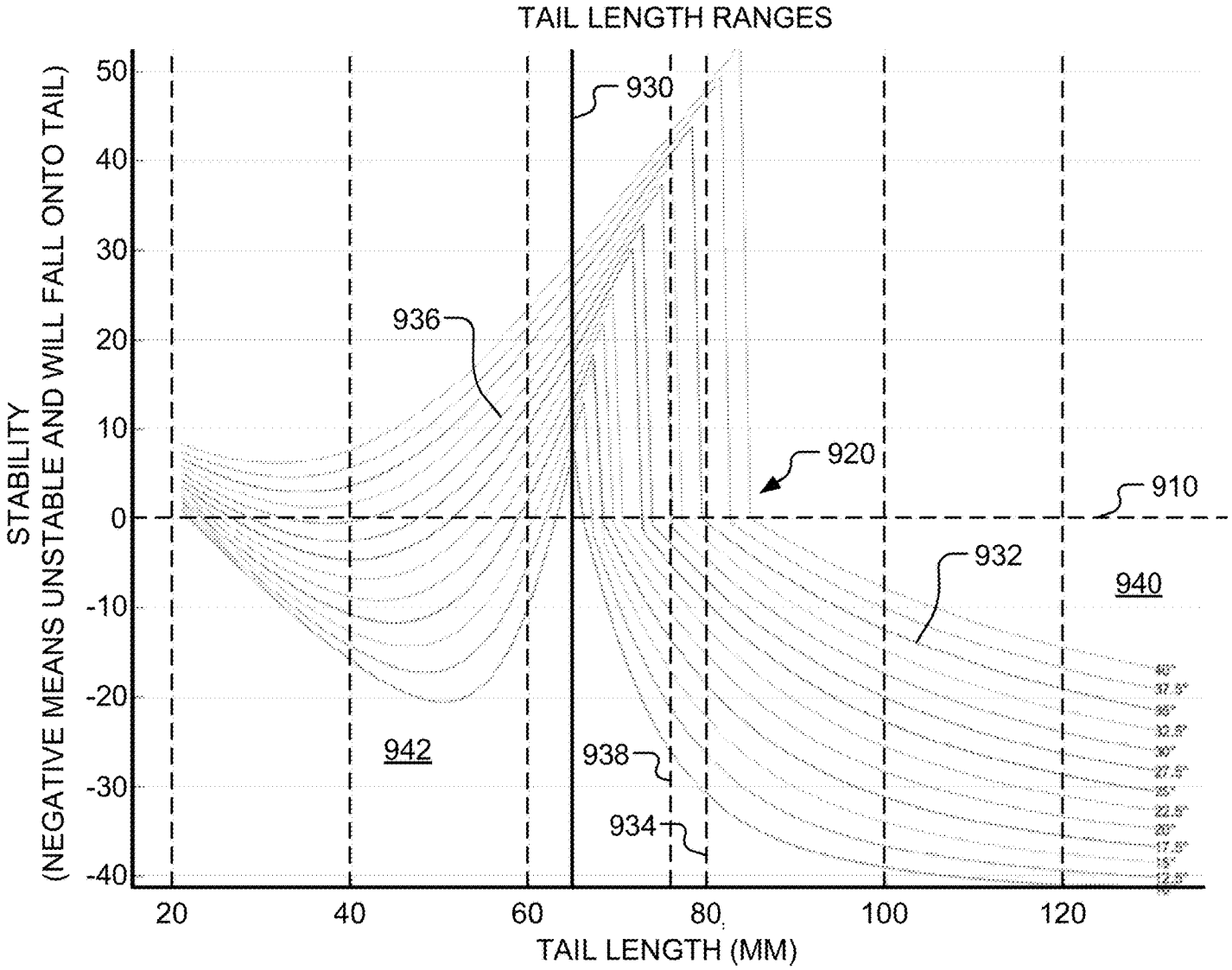
FIG. 11 is an example plot of feasibility regions in which the mechanized tail may be used to flip the mobile device.

The geometric relationship of FIGS. 10A and 10B may be modeled in MATLAB and this model may be used to compute feasibility regions for the length of the mechanized tail 160 (represented by "$l_t$" in FIG. 10A) and the minimum angle between the mechanized tail 160 and the platform 110 (represented by "θ" in FIG. 10A). FIG. 11 is a plot of exemplary feasibility regions obtained using this model. In the example illustrated in FIG. 11, the length of the mobile device 100 (represented by "$l_r$" in FIG. 10A) is equal to 65 mm and the position of the center gravity of the mobile device 100 (represented by "$C_g$" in FIGS. 10A and 10B) is equal to 21 mm. In FIG. 11, an x-axis is a range of values for the length of the mechanized tail 160 (represented by "$l_t$" in FIG. 10A) and a y-axis is a measure of stability of the mobile device 100. Negative values on the y-axis, which are those values below a dashed horizontal line 910, indicate that the mobile device 100 is unstable and capable of flipping over. In FIG. 11, a plurality of lines 920 each represent a different minimum angle between the mechanized tail 160 and the platform 110 (represented by "θ" in FIG. 10A).

As mentioned above, the length of the mobile device 100 (represented by "$l_r$" in FIG. 10A) has been set equal to 65 mm. Thus, the tail lengths to the right of a vertical line 930 exceed the length of the mobile device 100. As is apparent to those of ordinary skill in the art, if the mechanized tail 160 is sufficiently longer than the mobile device 100, the mechanized tail 160 can simply lift the propulsion mechanism(s) 120 (see FIGS. 1-5, 8, and 13-15) of the mobile device 100 and rotate the back portion 114 about the front portion 113 (see FIGS. 1 and 2) causing the mobile device 100 to perform a front flip (like the one illustrated in FIG. 5). Thus, FIG. 11 illustrates a front flip region 940 that extends from the right of the vertical line 930 and under the dashed horizontal line 910. Portions of the lines 920 falling within the front flip region 940 identify values of the minimum angle (represented by "θ" in FIG. 10A) and the length of the mechanized tail 160 (represented by "$l_t$" in FIG. 10A) that may perform a front flip. By way of a non-limiting example, if the minimum angle (represented by "θ" in FIG. 10A) is 35 degrees (as illustrated by a line 932 of the lines 920), and the length of the mechanized tail 160 (represented by "$l_t$" in FIG. 10A) is over 80 mm (represented by a dashed vertical line 934), the mobile device 100 will be able to perform a front flip (but not a back flip).

On the other hand, the tail lengths to the left of the vertical line 930 do not exceed the length of the mobile device 100. In this region, only a back flip may be possible if the stability value on the y-axis is negative for a particular minimum angle (represented by "θ" in FIG. 10A). Thus, FIG. 11 illustrates a back flip region 942 that extends from the left of the vertical line 930 and under the dashed horizontal line 910. Portions of the lines 920 falling within the back flip region 942 identify values of the minimum angle (represented by "θ" in FIG. 10A) and the length of the mechanized tail 160 (represented by "$l_t$" in FIG. 10A) that may perform a back flip.

Interestingly, in FIG. 11, there are some minimum angles (represented by "θ" in FIG. 10A) for which no tail lengths will cause the mobile device 100 to become unstable enough to perform a back flip. This appears to happen right around 30 degrees (represented by a line 936 of the lines 920). At that angle or greater, the mobile device 100 may be flipped without relying on any sort of inertia by making the mechanized tail 160 long enough to execute a front flip. In other words, some of the lines 920 do not have portions within the back flip region 942 but do have portions within the front flip region 940. Thus, for such lines, only a front flip is possible.

Figure 12:
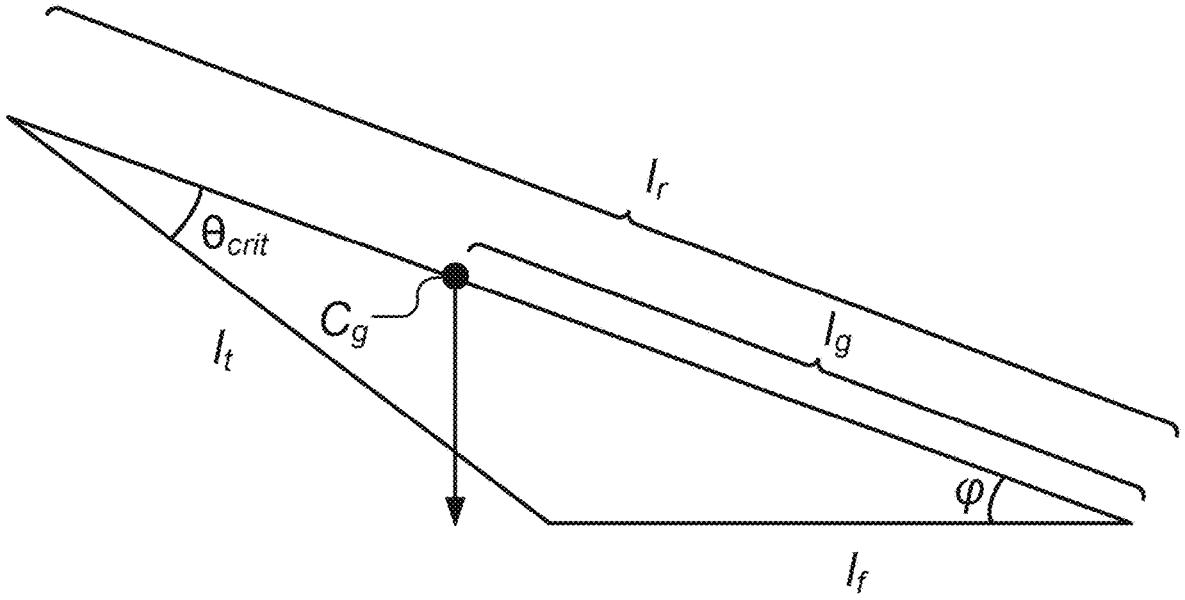
FIG. 12 is a diagram illustrating example geometry of a closed-form solution for flipping the mobile device.

Referring to FIG. 12, a (critical) minimum angle (represented by "$\theta_{crit}$") for a particular tail length (represented by "$l_t$" in FIGS. 10A and 12) may be computed in closed-form using the following geometric relationships:

$$l_r = l_f \cos\varphi + l_t \cos\theta \quad (1)$$

$$l_f \le l_g \cos\varphi \quad (2)$$

$$l_f \sin\varphi = l_t \sin\theta \quad (3)$$

In equations (1)-(3) above, "$l_g$" represents a position of the center gravity of the mobile device 100 measured from the front portion 113 (see FIGS. 1 and 2) of the mobile device 100. Also, referring to FIG. 1, "$l_f$" of FIG. 12 represents a distance between the front portion 113 of the mobile device 100 and the tip 134 of the mechanized tail 160. Returning to FIG. 12, as mentioned above, "$l_r$" represents the length of the mobile device 100.

These equations (1)-(3) permit a closed-form quadratic equation (4):

$$l_t^2+(l_g-2l_r)l_t\cos\theta+(l_r-l_g)l_r\leq 0 \tag{4}$$

Finally, for a fixed body length (represented by "$l_r$" in FIGS. 10A and 12), fixed center of gravity position (represented by "$l_g$" in FIG. 12), the critical minimum angle (represented by "$\theta_{crit}$" in FIG. 12 and equation (5)) may be calculated using equation (5):

$$\theta_{crit}=\arccos\left(\frac{-l_t^2-(l_r-l_g)l_r}{(l_g-2l_r)l_t}\right) \tag{5}$$

The equation (5) may alternatively be used to calculate the minimum required tail length (represented by "$l_t$" in FIGS. 10A and 12) for a particular (critical) minimum angle (represented by "$\theta_{crit}$" in FIG. 12 and equation (5)).

As mentioned above, referring to FIG. 1, the undesired orientation may include the mobile device 100 being positioned on either the left side portion 115 or the right side portion 116. When the mobile device 100 is in such a position, the mechanized tail 160 may create an imbalance in the position of the mobile device 100 that combined with movement of the propulsion mechanism(s) 120 (e.g., the drive wheels 120A and 120B), causes the mobile device 100 to fall or roll into the desired orientation (e.g., right-side up).

References to "an" embodiment in this disclosure are not necessarily to the same embodiment.

It is the applicant's intent that only claims that include the express language "means for" or "step for" be interpreted under 35 U.S.C. § 112. Claims that do not expressly include the phrase "means for" or "step for" are not to be interpreted under 35 U.S.C. § 112.

The purpose of the Abstract of the Disclosure is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract of the Disclosure is not intended to be limiting as to the scope in any way.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

While particular embodiments of the present invention have been shown and described, it will be obvious to those of ordinary skill in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those of ordinary skill in the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Accordingly, the invention is not limited except as by the appended claims.

The invention claimed is:

1. A wireless wheeled vehicle comprising:

a first portion opposite a second portion;

a body;

one or more drive wheels operable to propel the wireless wheeled vehicle across a driving surface, the one or more drive wheels being mounted on the body at one or more mount locations positioned in between the first portion and the second portion, the wireless wheeled vehicle being in a first orientation while being propelled across the driving surface by the one or more drive wheels, the wireless wheeled vehicle being in a second orientation when the wireless wheeled vehicle is upside-down with respect to the first orientation; and a member having a base portion opposite a free end portion, the base portion being pivotably mounted to the second portion of the wireless wheeled vehicle and spaced outwardly from the one or more mount locations, the base portion being pivotable to move the free end portion into and out of contact with the driving surface when the wireless wheeled vehicle is in the first orientation, the base portion being pivotable to move the free end portion into and out of contact with the driving surface when the wireless wheeled vehicle is in the second orientation;

an attachment configured to be attached to the member and be movable thereby; and at least one actuator mounted on the body and connected to the base portion of the member, (a) when the wireless wheeled vehicle is in the first orientation and has become stuck on at least one obstacle, the at least one actuator being configured to:

pivot the base portion in a first direction causing the free end portion to contact the driving surface while the wireless wheeled vehicle is in the first orientation, after the first portion contacts the driving surface, continue pivoting the base portion in the first direction causing the member to lift the one or more drive wheels above the driving surface, and position the first portion into contact with the driving surface, and after the first portion contacts the driving surface, pivot the base portion in a second direction causing the free end portion to rotate away from the driving surface to thereby lower the one or more drive wheels into contact with the driving surface and reposition the one or more drive wheels with respect to the driving surface, (b) when the wireless wheeled vehicle is in the second orientation, the at least one actuator being configured to:

pivot the base portion in a third direction to thereby position the free end portion in contact with the driving surface, cause the member to lift the one or more drive wheels off the driving surface, and cause the member to flip the wireless wheeled vehicle from the second orientation to the first orientation.

2. The wireless wheeled vehicle of claim 1, wherein the at least one actuator is configured to cause the first portion to contact the driving surface, and the at least one actuator is configured to continue pivoting the base portion in the third direction causing the wireless wheeled vehicle to flip about the first portion into the first orientation.

3. The wireless wheeled vehicle of claim 1, wherein the at least one actuator is configured to continue pivoting the base portion in the third direction causing the wireless wheeled vehicle to fall onto the member after the one or more drive wheels have been lifted off the driving surface, and the at least one actuator is configured to pivot the base portion in the second direction to cause the wireless wheeled vehicle to flip about the second portion into the first orientation after the wireless wheeled vehicle has fallen.

4. The wireless wheeled vehicle of claim 1, further comprising:

an onboard control mechanism configured to determine whether the wireless wheeled vehicle is in the second orientation or the first orientation, the onboard control mechanism being configured to cause the at least one actuator to position the member to flip the wireless wheeled vehicle into the first orientation when the onboard control mechanism determines the wireless wheeled vehicle is in the second orientation.

5. The wireless wheeled vehicle of claim 4, further comprising:

at least one navigation sensor configured to send navigation information to the onboard control mechanism, the onboard control mechanism being configured to cause the one or more drive wheels to move the wireless wheeled vehicle across the driving surface autonomously based on the navigation information only when the wireless wheeled vehicle is in the first orientation.

6. The wireless wheeled vehicle of claim 5, further comprising:

an inertial measurement device configured to send orientation information to the onboard control mechanism, the onboard control mechanism being configured to determine whether the wireless wheeled vehicle is in the second orientation or the first orientation based at least in part on the orientation information.

7. The wireless wheeled vehicle of claim 1, wherein the member is positionable to help prevent the wireless wheeled vehicle from losing balance when the driving surface includes uneven or slippery terrain.

8. The wireless wheeled vehicle of claim 1, further comprising:

an onboard control mechanism configured to receive instructions from at least one external system and cause the at least one actuator to pivot the base portion in accordance with those instructions.

9. The wireless wheeled vehicle of claim 1, further comprising:

an onboard control mechanism configured to send pivot instructions to the at least one actuator, the at least one actuator being operable to pivot the base portion in accordance with the pivot instructions.

10. The wireless wheeled vehicle of claim 1, further comprising:

a gear box connecting the at least one actuator to the base portion, the at least one actuator being operable to cause the gear box to pivot the base portion; and an onboard control mechanism configured to send pivot instructions to the at least one actuator, the at least one actuator being operable to cause the gear box to pivot the base portion in accordance with the pivot instructions.

11. The wireless wheeled vehicle of claim 1, further comprising:

an onboard control mechanism; and a motion drive configured to receive drive instructions from the onboard control mechanism and operate the one or more drive wheels in accordance with the drive instructions.

12. The wireless wheeled vehicle of claim 1, wherein the wireless wheeled vehicle has a side portion extending between the first portion and the second portion, the wireless wheeled vehicle is in an undesired orientation when the side portion is on the driving surface, and the member is positionable such that when the wireless wheeled vehicle is in the undesired orientation, operating at least one of the one or more drive wheels causes the wireless wheeled vehicle to roll into the first orientation.

13. A method performed by a wireless wheeled vehicle comprising a front portion, a back portion, a body, one or more drive wheels operable to propel the wireless wheeled vehicle across a driving surface, a member having a base portion opposite a free end portion, an attachment, and at least one actuator mounted on the body and connected to the base portion of the member, the attachment being configured to be attached to the member and be moved thereby, the one or more drive wheels being mounted on the body at one or more mount locations positioned in between the front portion and the back portion, the wireless wheeled vehicle being in a first orientation while being propelled across the driving surface by the one or more drive wheels, the wireless wheeled vehicle being in a second orientation when the wireless wheeled vehicle is upside-down with respect to the first orientation, the base portion being pivotably mounted to the back portion of the wireless wheeled vehicle and spaced outwardly from the one or more mount locations, the base portion being pivotable to move the free end portion into and out of contact with the driving surface when the wireless wheeled vehicle is in the first orientation, the base portion being pivotable to move the free end portion into and out of contact with the driving surface when the wireless wheeled vehicle is in the second orientation, the method comprising:

(a) when the wireless wheeled vehicle is in the first orientation and has become stuck on at least one obstacle while driving on the driving surface:

pivoting, with the at least one actuator, the base portion in a first direction to move the free end portion into contact with the driving surface while the wireless wheeled vehicle is in the first orientation;

after the free end portion contacts the driving surface, continuing to pivot, with the at least one actuator, the base portion in the first direction to lift the one or more drive wheels above the driving surface, and position the front portion into contact with the driving surface; and after the front portion contacts the driving surface, pivoting, with the at least one actuator, the base portion in a second direction causing the free end portion to rotate away from the driving surface to thereby lower the one or more drive wheels into contact with the driving surface and reposition the one or more drive wheels with respect to the driving surface; and (b) when the wireless wheeled vehicle is in the second orientation:

pivoting, with the at least one actuator, the base portion in a third direction to thereby position the free end portion in contact with the driving surface, causing, with the at least one actuator, the member to lift the one or more drive wheels off the driving surface, and causing, with the at least one actuator, the member to flip the wireless wheeled vehicle from the second orientation to the first orientation.

14. The method of claim 13, wherein causing the member to flip the wireless wheeled vehicle from the second orientation to the first orientation comprises:

causing, with the at least one actuator, the front portion to contact the driving surface, and continuing to pivot, with the at least one actuator, the base portion in the third direction to thereby cause the wireless wheeled vehicle to flip about the front portion into the first orientation.

15. The method of claim 13, wherein causing the member to flip the wireless wheeled vehicle from the second orientation to the first orientation comprises:

continuing to pivot, with the at least one actuator, the base portion in the third direction to thereby cause the wireless wheeled vehicle to fall onto the member after the one or more drive wheels have been lifted off the driving surface, and pivoting, with the at least one actuator, the base portion in the second direction to cause the wireless wheeled vehicle to flip about the back portion into the first orientation after the wireless wheeled vehicle has fallen.

16. The method of claim 13, wherein the wireless wheeled vehicle comprises an onboard control mechanism, and the method further comprises:

determining, with the onboard control mechanism, whether the wireless wheeled vehicle is in the second orientation or the first orientation, the onboard control mechanism causing the at least one actuator to position the member to flip the wireless wheeled vehicle into the first orientation when the onboard control mechanism determines the wireless wheeled vehicle is in the second orientation.

17. The method of claim 16, wherein the wireless wheeled vehicle comprises at least one navigation sensor, and the method further comprises:

causing, with the onboard control mechanism, the one or more drive wheels to move the wireless wheeled vehicle across the driving surface autonomously based on navigation information received by the onboard control mechanism from the at least one navigation sensor only when the wireless wheeled vehicle is in the first orientation.

18. The method of claim 17, wherein the wireless wheeled vehicle comprises an inertial measurement device, and the method further comprises:

determining, with the onboard control mechanism, whether the wireless wheeled vehicle is in the second orientation or the first orientation based at least in part on orientation information received by the onboard control mechanism from the inertial measurement device.

19. The method of claim 13, wherein the wireless wheeled vehicle has a side portion extending between the front portion and the back portion, the wireless wheeled vehicle is in an undesired orientation when the side portion is on the driving surface, and the method further comprises:

when the wireless wheeled vehicle is in the undesired orientation, positioning the member, with the at least one actuator, such that operating at least one of the one or more drive wheels causes the wireless wheeled vehicle to roll into the first orientation.

* * * * *